US006250038B1

(12) United States Patent
Akamine

(10) Patent No.: US 6,250,038 B1
(45) Date of Patent: Jun. 26, 2001

(54) BLOCK FOR RETAINING WALL AND METHOD FOR THE CONSTRUCTION OF RETAINING WALL USING THE SAME

(75) Inventor: Masumi Akamine, 7-61, Demachi, Kumamoto-shi (JP)

(73) Assignee: Masumi Akamine, Kumamoto (JP)

( * ) Notice: Subject to any disclaimer, the term of this patent is extended or adjusted under 35 U.S.C. 154(b) by 0 days.

(21) Appl. No.: 09/233,960

(22) Filed: Jan. 20, 1999

(30) Foreign Application Priority Data

Feb. 23, 1998 (JP) ..... 10-040629
Jul. 31, 1998 (JP) ..... 10-218265

(51) Int. Cl.[7] ..... E04B 2/20; E04C 1/39; E02D 29/02

(52) U.S. Cl. ..... 52/604; 52/421; 52/438; 52/439; 52/503; 52/606; 52/611; 52/742.14; 52/745.1; 52/747.12

(58) Field of Search ..... 52/421, 438, 439, 52/503, 604, 606, 611, 742.14, 745.1, 747.12

(56) References Cited

U.S. PATENT DOCUMENTS 1,496,754 * 6/1924 Eaves ..... 52/503
3,479,782 * 11/1969 Muse ..... 52/438
4,091,587 * 5/1978 Depka ..... 52/421
4,123,881 * 11/1978 Muse ..... 52/611 X
5,567,089 * 10/1996 Akamine ..... 52/611 X
5,839,243 * 11/1998 Martin ..... 52/439

* cited by examiner

*Primary Examiner*—Christopher T. Kent
(74) *Attorney, Agent, or Firm*—Shanks & Herbert

(57) ABSTRACT

A block for use in constructing a retaining wall system has a front wall and a partition wall formed backwards projecting from the front wall; wherein the partition wall is provided with a communicating hole extending vertically over the entire length thereof through and in which a reinforcing iron rod is disposed or inserted; the partition wall is provided on an upper surface with an upper depression such that the upper depression is enclosed with an upwardly raised peripheral edge portion having a top flat surface and an inner wall surface of the peripheral raised edge portion is gradually widened downwardly from the top surface edge toward the inside of the upper depression; the partition is further provided on a bottom surface with a lower depression such that the lower depression is enclosed with a downwardly reduced peripheral edge portion and an inner wall surface of the peripheral reduced edge portion is gradually narrowed downwardly from the bottom surface of the lower depression toward the bottom edge thereof; the upper depression communicates with the lower depression via the communicating hole; each of the upper and lower depressions is wider in lengthwise diameter than the communicating hole; the upper depression of the retaining wall block laid in a lower row is aligned upwardly with the lower depression of the adjacent retaining wall block laid in the adjacent upper row so as to form a node-shaped cavity; the communicating hole forms a column-shaped body of a filling and setting material filled through and in the communicating hole; and the node-shaped cavity forms a node-shaped body of the filling and setting material filled therein through the communicating hole.

The retaining wall block can withstand external forces and prevent the resulting retaining wall from falling down forwards and backwards. Further, the retaining wall constructed with the retaining wall blocks can withstand external forces acting vertically.

18 Claims, 20 Drawing Sheets

BLOCK FOR RETAINING WALL AND METHOD FOR THE CONSTRUCTION OF RETAINING WALL USING THE SAME

BACKGROUND OF THE INVENTION

1. Field of the Invention

The present invention relates to a block for use in constructing a retaining wall and a method for the construction of a retaining wall using the same.

2. Description of the Related Art

There is known a retaining wall block for use in constructing a retaining wall, which comprises a front wall and a partition wall formed backwards projecting from a rear surface of the front wall, the partition wall being formed with a communicating hole extending vertically over its entire length through and into which a reinforcing iron rod or rods is or are inserted and disposed.

When a retaining wall is to be constructed with the such retaining wall blocks, a plurality of the retaining wall blocks are laid in a row upwardly on a footing foundation so as to allow the communicating holes of the retaining wall blocks laid in the lower row to be aligned vertically with the communicating holes of the retaining wall blocks laid in an upper row.

More specifically, the footing foundation is formed integrally with a plurality of anchoring iron rods in a spaced arrangement so as to align with and extend upwardly through and in the communicating holes of the retaining wall blocks laid thereon and the reinforcing iron rods are disposed vertically so as to be inserted into and extend through the communicating holes of the retaining wall blocks laid on the footing foundation.

A plurality of the retaining wall blocks are laid in a row on the footing foundation so as to allow the communicating holes of the retaining wall blocks to align with the anchoring iron rods formed on the footing foundation and the reinforcing iron rods interconnected with the anchoring iron rods. After a row of the retaining wall blocks is laid on the footing foundation in the manner as described above, the communicating holes are filled with a filling and setting material such as concrete, mortar, etc. After the retaining wall blocks is laid in the lower row on the footing foundation and the communicating holes of the retaining wall blocks are filled with the filling and setting material, another plurality of the retaining wall blocks are laid in an upper row on the retaining wall blocks disposed in the lower row in the manner as described above and the communicating holes of the retaining wall blocks in the upper row were filled with the filling and setting material. A reinforced retaining wall can be constructed by repeating the laying of the retaining wall blocks in the manner as described above and the filling of the communicating holes with the filling and setting material until the retaining wall reaches a predetermined height.

A conventional retaining wall system using such retaining wall blocks poses various problems and difficulty.

The retaining wall system is required to withstand external forces such as, e.g. lateral shear forces because such lateral shear forces act upon a contact plane on which the adjacent retaining wall blocks constituting the retaining wall system contact with each other when an external force such as, for example, pressure of soil masses, works in a horizontal direction upon the retaining wall. In order to comply with this requirement, the conventional retaining wall system is constructed such that the number of interconnecting iron rods is increased. However, an increase in the number of the interconnecting iron rods leads to an increase in costs of construction and an prolongation of a construction period. Moreover, the retaining wall blocks cannot provide a retaining wall having a sufficiently high resistance to the lateral shear forces as compared with a retaining wall constructed by casting in place with concrete.

For iron-reinforced concrete constructions, as a general rule, it is desired to deal with the shear forces by increasing the strength of the concrete itself and any specification discloses this matter clearly. In the current situation, however, it is very difficult to build concrete constructions having a sufficient degree of physical strength as required by the specification.

Further, as a general rule, the front surface side of a retaining wall originally undergoes compressive forces under usual circumstances. In such an extreme case as in case of earthquake, etc., however, the front surface side of the retaining wall may undergo a tensile force caused by horizontal forces due to the horizontal seismic intensity in a way thoroughly opposite to the usual cases. At this instance, the iron-reinforced concrete construction may undergo upward or downward forces causing the retaining wall to slide vertically, i.e. upwardly or downwardly, whereby the retaining wall cannot function as an integral configuration and ensure a desired resistance force against the external forces.

Moreover, it is difficult to construct a retaining wall system in a rigid structure by laying a plurality of retaining wall blocks in plural rows one after another and increasing an amount of interconnecting iron rods for interconnecting the adjacent retaining wall blocks in such a manner that the retaining wall blocks laid adjacently and upwardly on each other are provided with resistance to vertical as well as longitudinal and lateral forces as comparable to a concrete retaining wall cast in place. Furthermore, the increase in the amount of the interconnecting iron rods lacks the economy of construction and increases the costs of construction.

SUMMARY OF THE INVENTION

Therefore, the present invention has the object to provide a block for use in constructing a retaining wall system that can overcome the problems prevailing in the conventional retaining wall system as described above.

Further, the present invention has another object to provide a method for the construction of a retaining wall using the retaining wall blocks according to the present invention.

In order to achieve the object as described above, the present invention in one aspect provides a block for use in constructing a retaining wall system, comprising: a front wall; and a partition wall formed projecting rearwards from the front wall; wherein the partition wall is provided with a communicating hole extending vertically over the entire length thereof through and in which a reinforcing iron rod is disposed or inserted; the partition wall is provided on an upper surface with an upper depression such that the upper depression is enclosed with an upwardly raised peripheral edge portion having a top flat surface and an inner wall surface of the peripheral raised edge portion is gradually widened downwardly from the top surface edge toward the inside of the upper depression; the partition is further provided on a bottom surface with a lower depression such that the lower depression is enclosed with a downwardly reduced peripheral edge portion and an inner wall surface of the peripheral reduced edge portion is gradually narrowed downwardly from the bottom surface of the lower depression toward the bottom edge thereof; the upper depression communicates with the lower depression via the communicating hole; each of the upper and lower depressions is wider in lengthwise diameter, i.e. diameter extending from the front side to the rear side, than the communicating hole; the upper depression of the retaining wall block disposed in a lower row is aligned with the lower depression of the adjacent retaining wall block laid in the adjacent upper row so as to form a node-shaped cavity between the upwardly adjacently disposed blocks; the communicating hole forms a column-shaped body of a filling and setting material filled through and in the communicating hole; and the node-shaped cavity forms a node-shaped body of the filling and setting material filled therein through the communicating hole.

In a preferred mode, the retaining wall block according to the one aspect of the present invention is configured such that the communicating hole is gradually tapered downwardly from a top opening portion toward a middle opening portion such that a lengthwise diameter, i.e. extending from the front side to the rear side, of the communicating hole at the top opening portion is larger than a lengthwise diameter of the communicating hole at the middle opening portion and tapered downwardly from the middle opening portion toward a bottom opening portion in the opposite manner, i.e., such that the lengthwise diameter of the communicating hole at the middle opening portion is less than a lengthwise diameter thereof at the bottom opening portion.

The present invention further provides in another aspect a retaining wall block comprised of a front wall and a partition wall with a plurality of communicating holes each extending vertically over the entire length thereof through and in which a reinforcing iron rod is inserted and disposed, wherein the plurality of the communicating holes are disposed such that the adjacent communicating holes communicate with each other via a communicating opening; the plurality of the communicating holes form column-shaped bodies of a filling and setting material filled therethrough and allowed to set therein; and the communicating opening forms a connecting body of the filling and setting material connecting the adjacent column-shaped bodies thereof with each other when the filling and setting material is filled therethrough and allowed to set therein.

In a preferred mode, the retaining wall block according to the another aspect of the present invention is configured in such a manner that the partition wall is provided on a top surface thereof with an upper depression and on a bottom surface thereof with a lower depression so as to allow the upper and lower depressions to communicate with each other through the communicating hole and each of the upper and lower depressions is longer in lengthwise diameter than the communicating hole and, when the retaining wall block is laid in an upper row on the retaining wall block disposed in a lower row, the lower depression of the retaining wall block disposed in the upper row forms a node-shaped cavity in association with the upper depression of the retaining wall block in the lower row and the upper depression the retaining wall block in the upper row also forms a node-shaped cavity in association with the lower depression of the retaining wall block in a further upper row to be laid upwardly on the retaining wall block disposed in the upper row; and, when the filling and setting material is filled through the communicating holes, the filling and setting material is allowed to set and cure therein to form a node-shaped projection of the filling and setting material integrally connecting to the column-shaped bodies of the filling and setting material filled and cured therein.

Further, the present invention provides in a preferred mode the retaining wall block according to the present invention is configured in such a manner that the communicating hole is gradually tapered inwardly from the top opening portion toward the middle opening portion such that the lengthwise diameter of the communicating hole at the top opening portion is larger than the lengthwise diameter thereof at the middle opening portion and tapered downwardly from the middle opening portion toward the bottom opening portion such that the lengthwise diameter of the communicating hole at the middle opening portion is less than the lengthwise diameter thereof at the bottom opening portion, and the filling and setting material filled in the communicating hole and cured therein forms a column-shaped body of the filling and setting material in the form in which the column-shaped body is corrugated at the front and opposed rear sides thereof.

In a still further preferred mode, the retaining wall block according to this aspect of the present application is configured in such a manner that a sub-partition wall is interposed between adjacent communicating holes such that a top surface of the sub-partition wall is located in the position lower than a top surface of the partition wall or the upper depression to provide an upper opening space so as to allow upper portions of the adjacent communicating holes to communicate with each other; and a bottom surface of the sub-partition wall is located in the position upper than a bottom surface of the partition wall so as to allow the lower portions of the adjacent communicating holes to communicate with each other; the upper opening space thereof forms a connecting cavity in association with the lower opening space of the retaining wall block laid in an adjacent upper row and likewise the lower opening space thereof forms a connecting cavity in association with the upper opening space of the retaining wall block laid in an adjacent lower row, and each of the connecting cavities forms a connecting body of the filling and setting material integrally connecting the adjacent column-shaped bodies of the filling and setting material filled and cured therein.

Still further, the present invention in a preferred mode provides the retaining wall block which is configured in such a manner that the communicating hole is gradually tapered inwardly from the top opening portion toward the middle opening portion such that the lengthwise diameter of the communicating hole at the top opening portion is larger than the lengthwise diameter thereof at the middle opening portion and tapered downwardly from the middle opening portion toward the bottom opening portion such that the lengthwise diameter thereof at the middle opening portion is less than that thereof at the bottom opening portion; and when the filling and setting material is filled through the communicating hole and allowed to cure therein, the filling and setting material forms a column-shaped body in the communicating hole having the front and rear sides formed with corrugated surfaces.

In a further preferred mode according to this aspect of the present invention, the retaining wall block is configured in such a manner that the sub-partition wall interposed laterally between the side walls of the partition wall is provided at its intermediate portion with a communicating opening or openings communicating the adjacent communicating holes with each other; and the filling and setting material filled in the communicating opening and openings forms a connecting body or bodies connecting the adjacent column-shaped bodies of the filling and setting material formed by filling the filling and setting material into the adjacent communicating holes and allowing it to set and cure therein.

In a still further preferred mode, the retaining wall block is configured in such a fashion that the sub-partition wall is disposed so as for the top surface portion to be located below the top surface portion of the communicating hole or the upper depression and/or so as for the bottom surface portion to be located above the top surface portion of the communicating hole at the bottom opening portion or the lower depression, thereby communicating the upper portions of the adjacent communicating holes and/or communicating the lower portions thereof The present invention provides in another preferred mode the retaining wall block having the front wall and the partition wall with a plurality of communicating holes each extending vertically over the entire length such that a pair of upper and lower beams are interposed vertically between the inner sides of each communicating hole of the partition wall so as to provide a communicating opening space between the upper and lower beams communicating the adjacent communicating holes with each other; and the filling and setting material filled in the adjacent communicating holes and the communicating opening space is allowed to set and cure to provide the column-shaped bodies with the connecting body of the cured filling and setting material connecting the column-shaped bodies to each other.

In a further preferred mode according to this aspect of the present invention, the retaining wall block is configured in such a manner that the partition wall is provided with the upper depression on its top surface and with the lower depression on its bottom surface so as to communicate the upper depression with the lower depression through the communicating hole disposed vertically over the entire length of the retaining wall block, the upper and lower depressions form a node-shaped cavity between the retaining wall blocks laid upwardly in adjacent upper and lower rows, and the filling and setting material filled in the communicating holes and the node-shaped cavity is allowed to set and cure therein forming a node-shaped body of the filling and setting material integral with and projecting from the column-shaped body of the filling and setting material filled and cured in the communicating hole.

Moreover, the present invention provides in a still further preferred mode the retaining wall block which is configured in such a way that the upper and lower beams are provided in a spaced relationship apart to some extent from the top opening surface or the upper depression and from the bottom opening surface or the lower depression so as to form each a communicating opening space communicating the adjacent communicating holes with each other; and the filling and setting material filled in the communicating holes and the communicating opening spaces is allowed to set and cure therein forming a connecting body of the filling and setting material integral with and projecting from the column-shaped body of the filling and setting material filled and cured in the communicating hole.

In a preferred mode according to the present invention, the retaining wall block is further configured in such a manner that the upper beam is gradually tapered inwardly from the top portion toward the bottom portion such that the lengthwise width at the top portion thereof is smaller than the lengthwise width at the bottom portion thereof and that the lower beam is gradually tapered downwardly from the top portion toward the bottom portion such that the lengthwise width at the top portion thereof is larger than the lengthwise width at the bottom portion thereof; the filling and setting material filled in the communicating holes is allowed to set and cure to provide a column-shaped body of the filling and setting material having the longitudinally opposed and facing side surfaces descending and ascending together, i.e. the lengthwise diameter of the column-shaped body tapered gradually such that the lengthwise diameter of the opening at the top portion of the upper beam is larger than the lengthwise diameter of the opening at the bottom portion thereof and the lengthwise diameter of the opening at the top portion of the lower beam is smaller than the lengthwise diameter thereof at the bottom portion; and the column-shaped bodies of the filling and setting material filled and cured in the communicating holes are interconnected with each other through the connecting bodies.

Further, the present invention in a preferred mode provides the retaining wall block which is configured in such a fashion that a bottom plate is integrally formed with the front wall and the partition wall such that the bottom plate extends from the bottom side end of the front wall backwards parallel to the partition wall up to the position behind the rear end side of the partition wall.

Moreover, in a further aspect of the present invention, there is provided a method for the construction of a retaining wall or a like construction, comprised of a series of processes of laying the retaining wall blocks in a row on the footing foundation so as to align the anchoring iron rods disposed therein with the communicating holes of the retaining wall blocks, filling the filling and setting material through and in the communicating holes of the retaining wall blocks laid thereon and allowing it to set and cure therein, and laying the retaining wall blocks in an upper row upwardly on the retaining wall blocks disposed in the lower row, filling the filling and setting material through and in the communicating holes of the retaining wall blocks laid in the lower row and allowing it to set and cure therein, and repeating a series of the processes of laying the retaining wall blocks in an upper row upwardly on the retaining wall blocks in a lower row and filling the filling and setting material in the communicating holes of the retaining wall blocks in the upper row and allowing it to set and cure therein, wherein the filling and setting material is filled in the communicating holes so as for a portion of the filling and setting material to fill the cavities and the communicating opening spaces formed in the retaining wall blocks laid in the upper and lower rows to form the column-shaped bodies and the connecting bodies of the filling and setting material.

In a preferred mode according to this aspect of the present invention, the construction method is arranged such that the retaining wall blocks are laid in an upper row upwardly on the retaining wall blocks disposed in a lower row so as to align the communicating holes of the retaining wall blocks laid in the upper row with the corresponding communicating holes of the retaining wall blocks disposed in the lower row and so as to allow the upper depression of the retaining wall block disposed in the lower row and the lower depression of the retaining wall block laid in the upper row to form a node-shaped cavity between the retaining wall blocks laid in the lower and upper rows; filling the filling and setting material through the communicating holes so as to cause a portion of the filling and setting material to be filled in the node-shaped cavity and the communicating opening space or spaces, if any, to form the column-shaped body and the connecting body or bodies, if any.

In a further preferred mode of the method according to the present invention, the retaining wall block are configured such that the communicating hole is gradually narrowed inwardly from the top opening portion toward the middle opening portion thereof and it is gradually widened outwardly from the middle opening portion toward the bottom opening portion and the communicating holes of the retaining wall blocks laid upwardly in the plural rows are filled with the filling and setting material to form a column-shaped body of the filling and setting material having a corrugated surface on the front and opposed rear sides of the communicating hole.

Still further, the present invention provides the method in a preferred mode wherein the retaining wall block is configured such that the upper depression is provided with the additional reinforcing iron rods in a network or lattice structure.

The other objects, features and advantages of the present invention will become apparent in the course of the description of the specification of the present application with reference to the accompanying drawings.

DESCRIPTION OF THE PREFERRED EMBODIMENTS

Figure 1:
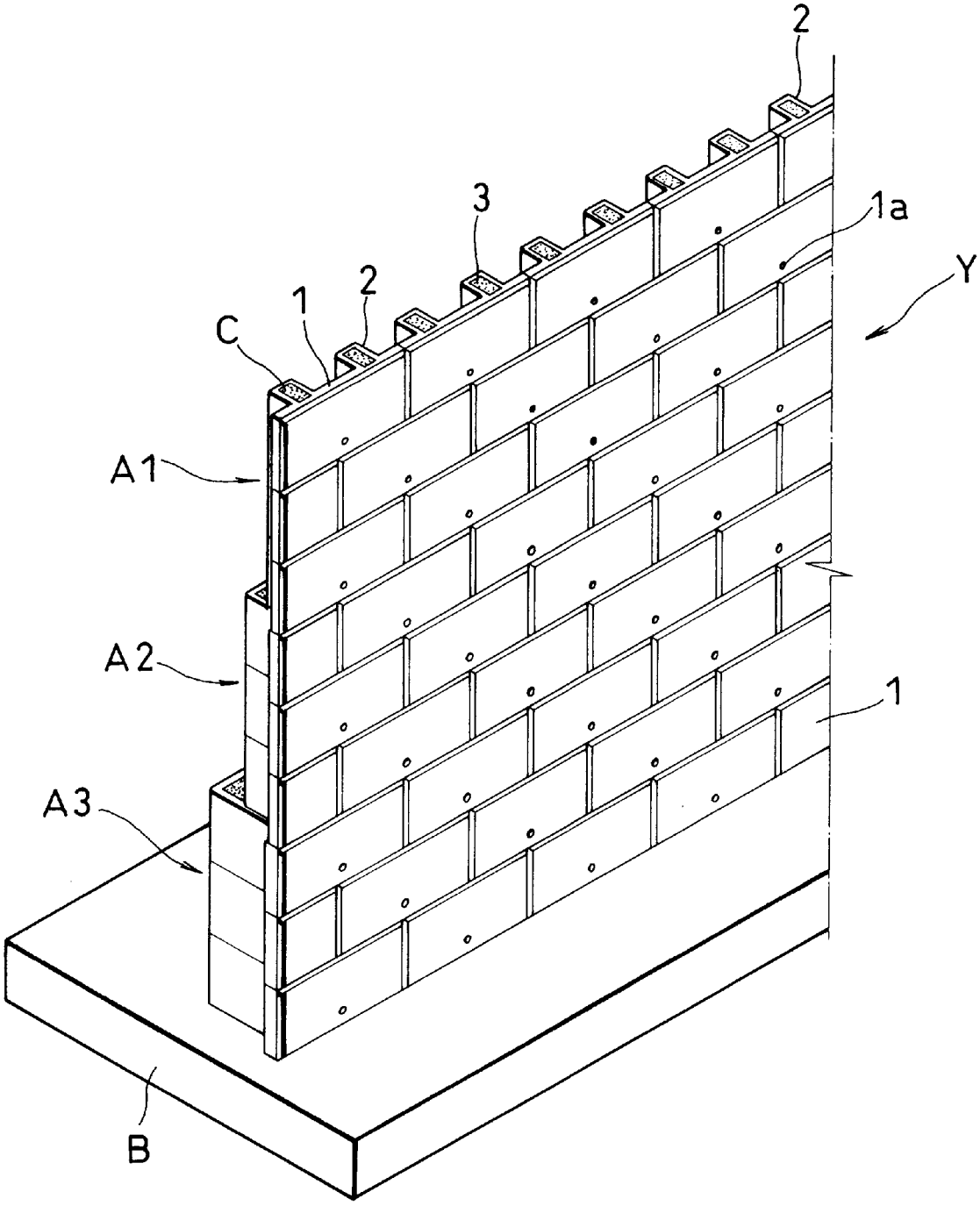
FIG. 1 is a perspective view showing a portion of a retaining wall constructed from retaining wall blocks according to an embodiment of the present invention when viewed from the front side.

The retaining wall block according to the present invention has a basic configuration comprising a front wall and a partition wall formed integrally with the rear side of the front wall projecting backwards, wherein the partition wall is provided with a communicating hole or holes, each extending vertically over the entire length thereof, through and in which a reinforcing iron rod or rods is or are inserted and disposed and a filling and setting material is filled.

The retaining wall block according to the present invention is configured in a characterizing aspect such that the partition wall is provided with an upper depression on an upper surface thereof and with a lower depression on a bottom surface thereof The upper depression comprises a concave upper depression portion and an upwardly raised peripheral top edge portion enclosing the concave upper depression portion and having a flat top surface and the lower depression comprises a concave lower depression portion and a downwardly extending peripheral bottom edge portion enclosing the concave lower depression portion in substantially the same manner as the upper depression. The upper depression and the lower depression are formed so as to enclose the communicating hole disposed extending vertically through the respective top and bottom opening portions. Moreover, the upper depression is formed communicating with the lower depression through the communicating hole.

Further, the upper depression and the lower depression are configured in such a manner that the upper depression forms a cavity in association with the lower depression when the retaining wall blocks are laid upwardly in plural rows. More specifically, when an upper retaining wall block is laid upwardly on a lower retaining wall block, the upper depression of the lower retaining wall block is aligned with the lower depression of the upper retaining wall block forming a cavity at the contact plane on which the upper and lower retaining wall blocks are in contact with each other. As the lengthwise diameter of each of the upper depression and the lower depression is larger than the lengthwise diameter of each of the top opening portion and the bottom opening portion of the communicating hole, the upper cavity formed by the upper depression of the retaining wall block in association with the lower depression of the retaining wall block laid upwardly in the upper has the lengthwise diameter larger than the top opening portion of the communicating hole, on the one hand, and the lower cavity formed by the lower depression of the retaining wall block in association with the upper depression of the retaining wall block disposed in a lower row has the lengthwise diameter larger than the bottom opening portion of the communicating hole, on the other. In this configuration of the upper depression and the lower depression of the retaining wall block, each of the upper and lower depressions is in a node-shaped form projecting from the peripheral side surfaces of the communicating hole.

When the node-shaped cavity is filled with a filling and setting material by filling it through and in the communicating hole and the filling and setting material is allowed to set and cure therein, the filling and setting material set and cured therein forms a node-shaped body projecting integrally from a column-shaped body or bodies of the filling and setting material set and cured in the communicating hole. This configuration of the node-shaped body of the filling and setting material in association with the column-shaped body can provide the resistance against external forces such as, e.g. lateral shear forces, etc. when a retaining wall is constructed with the retaining wall blocks according to the present invention. Further, it can be noted that the resistance of the retaining wall according to the present invention is comparable to that of a cast-in-place retaining wall.

It is further noted that each of the upper depression and the lower depression is preferably formed over the substantially entire area of the respective top and bottom surfaces, i.e. over the area extending from the rear end portion of the rear side of the front wall to the rear end portion of the partition wall and from the left side end portion to the right side end portion of the partition wall.

It is to be noted herein that this configuration of the upper depression and the lower depression of the partition wall can improve the resistance of the resulting retaining wall against the external forces, particularly against the lateral shear forces acting upon the contact plane on which the retaining wall blocks in adjacent rows are in contact with each other. At the same time, the disposition of the node-shaped projections on the peripheral side wall portions of the column-shaped body can provide improved resistance of the external forces particularly acting upon the retaining wall upwardly or downwardly. As a matter of course, when a retaining wall is constructed with the retaining wall blocks, the interconnection of the filling and setting material set and cured in the communicating hole as a column-shaped body with the node-shaped projections can also withstand external forces such as earth pressure, etc., acting upon the rear side of the retaining wall in usual circumstances and acting backwards from the front side of the retaining wall in unusual circumstances, e.g. in case of earthquake. Further, as the retaining wall block according to this embodiment of the present invention can improve the resistance against the external forces, it is possible to reduce the amount of interconnecting iron rods disposed in the footing foundation and this can also reduce the area of the footing foundation, leading to a reduction of the area of a construction site of a retaining wall or a like building. This leads to a shortened period of construction and reduced costs of construction.

As another embodiment of the present invention, the retaining wall block comprises a front wall and a partition wall disposed in substantially the same manner as the basic configuration of the retaining wall block as described above. The retaining wall block is further provided with a plurality of communicating holes, each extending vertically through the entire length thereof, which are divided with a sub-partition wall or walls and which communicate with each other through a communicating opening interposed between the adjacent communicating holes.

It is to be noted herein that the sub-partition wall may assume any form as long as it can divide the communicating hole into plural communicating holes and it fails to adversely affect the strength of the retaining wall block and it is not detrimental to the retaining wall resulting therefrom and likewise that the communicating opening may be in any form as long as it communicates the adjacent communicating holes and it fails to adversely affect the strength of the retaining wall block and it is not detrimental to the retaining wall constructed therewith.

In a specific configuration of the retaining wall block according to the present invention, the retaining wall block comprises a front wall and a partition wall formed integrally with the rear side surface of the front wall and extending rearwards therefrom. The partition wall is provided with a plurality of the communicating holes, each extending vertically over the entire length thereof, which are divided with a sub-partition wall or walls. Each of the sub-partition wall is disposed such that the top surface is located below the top opening portions of the adjacent communicating holes to form an upper communicating opening section and/or the bottom surface is located above the top opening portions of the adjacent communicating holes to form a lower communicating opening section.

Each of the communicating holes may be configured in such a manner that it is gradually tapered inwardly or downwardly from the top opening portion toward the middle opening portion such that the lengthwise diameter, i.e. the length extending from the front side and the rear side, of the communicating hole at the top opening portion is larger than the lengthwise diameter thereof at the middle opening portion and it is gradually tapered outwardly or downwardly from the middle opening portion toward the bottom opening portion such that the lengthwise diameter thereof at the middle opening portion is less than the lengthwise diameter thereof at the bottom opening portion. On the other hand, the sub-partition wall may be configured in such a fashion that it is gradually tapered inwardly from the top portion toward the middle portion such that the lengthwise width, i.e. the width extending from the front side to the rear side, of the sub-partition wall at the top portion is less than the lengthwise width thereof at the middle portion and downwardly from the middle portion toward the bottom portion such that the lengthwise diameter of the sub-partition wall at the middle portion is larger than the lengthwise diameter thereof at the bottom portion. Therefore, the upper half of the front communicating hole is gradually tapered inwardly from the top opening portion toward the middle opening portion such that the lengthwise diameter of the upper half portion of the front communicating hole, i.e. the diameter extending from the front side of the communicating hole to the rear side thereof at the top opening portion is larger than the lengthwise diameter thereof at the middle opening portion and the lower half portion of the first communicating hole is configured in the fashion opposite to the upper half portion thereof The rear communicating hole may be formed in substantially the same manner as the front communicating hole. When the number of the communicating holes is larger than two, the rest of the communicating holes may be configured in substantially the same manner as the front and rear communicating holes. The retaining wall blocks in this configuration can provide the resulting column-shaped bodies of the filling and setting material with corrugated surfaces, thereby improving the resistance against the external forces, particularly from the vertical forces that cause the column-shaped bodies to slide upwardly or downwardly.

This configuration of the sub-partition wall provides an upper cavity and a lower cavity when the retaining wall blocks are laid in plural rows. More specifically, when the retaining wall block is laid upwardly on the retaining wall block disposed in a lower row, the upper opening portions of the upper retaining wall block form a communicating cavity in association with the lower opening portions of the lower retaining wall block and the lower opening portions thereof form a communicating cavity in association with the upper opening portions of a retaining wall block disposed in a lower row. Each of the communicating cavities communicates with the adjacent communicating holes. When the filling and setting material is filled in the communicating holes and allowed to set, the filling and setting material set and cured therein forms a column-shaped body of the filling and setting material. At the same time when the filling and setting material is filled in the communicating holes, a portion of the filling and setting material is also filled in the cavities and the filling and setting material filled therein forms a connecting body of the filling and setting material upon setting and curing, which integrally connects the adjacent column-shaped bodies to each other.

The interconnection of the column-shaped bodies of the filling and setting material with the node-shaped bodies and/or the connecting bodies can provide the resulting retaining wall with improved strength against the external forces acting upon the retaining wall vertically, i.e. upwardly or downwardly, as well as horizontally, i.e. forwards or backwards. The disposition of the connecting bodies of the filling and setting material interconnecting the adjacent column-shaped bodies can prevent the column-shaped bodies particularly from sliding upwardly or downwardly due to the external forces.

More specifically, the filling and setting material set and cured in the communicating hole as a column-shaped body can demonstrate the resistance to a positive bending moment caused, e.g., by earth pressure, etc., acting from the rear side of the retaining wall toward the front side thereof in usual circumstances. The interconnection of the column-shaped bodies with the node-shaped bodies and/or the connecting bodies of the filling and setting material can also provide the retaining wall as a rigid structure with improved resistance to a negative bending moment caused under unusual circumstances, e.g. in case of earthquake, etc., which acts from the front wall side toward the backside, in substantially the same manner as under usual circumstances.

When the retaining wall is constructed with the retaining wall blocks according to the present invention, the retaining wall is provided with the improved resistance against the external forces in the manner as described above and the construction of the retaining wall according to the present invention can reduce the amount of interconnecting iron rods resulting in a decrease in the area of construction of the footing foundation and eventually leading to a reduction in the area of construction of the retaining wall itself This can shorten the period of construction and reduce costs of construction.

In a further specific embodiment of the retaining wall block according to the present invention, the sub-partition wall is provided with a communicating opening or openings at its intermediate portion or portions so as to communicate the adjacent communicating holes with each other. The disposition of the communicating opening or openings at the intermediate portion or portions of the retaining wall block can provide substantially the same effects as achieved by the retaining wall block with the upper and/or lower communicating opening or openings in the manner as described above. The communicating intermediate opening or openings can be formed in a connecting body or bodies in the equal manner as above when the filling and setting material is filled through the communicating holes and allowed to set and cured therein. It is also noted herein that the connecting body or bodies of the filling and setting material at the intermediate portion or portions of the retaining wall block can demonstrate substantially the same effects as the retaining wall block having the upper and/or lower opening section or sections.

It is further to be noted that the intermediate opening or openings may be provided for the retaining wall block in combination with the upper and/or lower opening section or sections as described above. This configuration can provide the retaining wall with substantially the same effects upon the external forces acting vertically as well as horizontally upon the retaining wall as the retaining wall block with the upper and/or lower communicating opening or openings.

In a further specific embodiment of the retaining wall block according to the present invention, the retaining wall block is configured in such a manner that the sub-partition walls are divided with a pair of upper and lower beams disposed in a vertically spaced arrangement. In this configuration, the space vertically apart between the upper and lower beams functions a communicating opening communicating the adjacent communicating holes with each other. The communicating opening is filled with the filling and setting material and forms a connecting body of the filling and setting material when allowed to set and cure therein, which connects the adjacent column-shaped bodies of the cured material filled in the adjacent communicating holes. It is apparent that the connecting body acts and functions in substantially the same manner as the intermediate connecting body of the retaining wall block in the previous specific embodiment of the present invention as described above.

In a still further specific embodiment of the retaining wall block according to the present invention, the upper and lower beams may be configured in such a manner that the upper beam is disposed in a downwardly spaced relationship apart vertically from the top opening surface of the communicating hole, i.e., below the top opening surface thereof, to form an upper communicating opening section and the lower beam is disposed in an upwardly spaced relationship apart vertically from the bottom opening surface thereof, i.e. above the bottom opening surface thereof, to form a lower communicating opening section. The upper and/or lower communicating opening sections are or is disposed connecting the upper and/or lower portions of the adjacent communicating holes and can work in substantially the same manner as the upper and/or lower opening sections of the retaining wall block in the previous specific embodiment of the retaining wall block according to the present invention.

Further, in a specific embodiment of the retaining wall block according to the present invention, the upper and/or lower beams may be configured in such a manner that the upper beam is gradually tapered inwardly from the top portion toward the bottom portion such that the lengthwise width, i.e. the width extending from the front side to the rear side, of the top portion is less than the lengthwise width of the bottom portion and/or that the lower beam is gradually tapered downwardly from the top portion toward the bottom portion such that the lengthwise width of the top portion is larger than the lengthwise width of the bottom portion. The configuration of the upper and lower beams provides the column-shaped body with corrugated side surfaces, thereby enhancing the resistance against the upwardly or downwardly sliding movement of the column-shaped body as well as the horizontal movement of the retaining wall.

As a still further embodiment of the present invention, the retaining wall block may be provided with a bottom plate integral with the bottom end portions of the front wall and the partition wall and extending backwards from the bottom end portion of the front wall in generally parallel to the side walls of the partition wall or walls and ending at the position equal to or behind the rear side end or ends of the partition wall or walls. The disposition of the bottom plate on each of the retaining wall blocks in the above embodiments can increase the safety of the retaining wall against falling down forwards because it can be laid on the retaining wall block disposed in a lower row with three sides secured with the construction site.

It is preferred that the retaining wall block with the bottom plate is disposed at least at an intermediate location of the retaining wall constructed from the retaining wall blocks in the previous embodiments of the present invention. When the retaining wall block with the bottom plate is disposed at an intermediate location of the retaining wall, the total weight load of a backfill material such as the earth, etc. filled over the bottom plate can be placed on the retaining wall blocks in lower rows in a backward direction and produce the negative moment of rotation that cause the retaining wall to fall down or turn over backwards, thereby securing the tightness among the retaining wall blocks of the retaining wall. Therefore, the retaining wall can be provided with the moment for resisting the overturning by the amount corresponding to the negative moment of rotation and the stability of the retaining wall against the overturning can be ensured as a whole.

As described above, when the retaining wall block with the bottom plate is disposed at an intermediate portion of the retaining wall, the backfill material placed thereon can work as a load and the vertical load of the retaining wall as a whole can be increased leading to raising frictional forces at each of the contact surface portions among the retaining wall blocks of the retaining wall and consequently improving the stability against the sliding pressure for sliding the retaining wall blocks horizontally from the retaining wall.

This configuration can also serve as reducing the area of the footing foundation and the area of construction of the retaining wall itself, resulting in the shortening of the period of construction and the reduction in costs of construction.

Now, a generic description will be made of an embodiment of the method for the construction of a retaining wall using the retaining wall blocks according to the present invention.

A footing foundation is provided with anchoring iron rods in an appropriately spaced relationship at a predetermined interval. A retaining wall block of an appropriate size is laid on the footing foundation in a row so as to align the communicating hole or holes with the anchoring iron rod or rods and to allow the anchoring iron rod or rods to be inserted through the communicating hole or holes. Thereafter, the communicating hole or holes of the retaining wall blocks in a row is or are filled with a filling and setting material up to the top opening portion or portions. After the filling and setting material has been filled in the communicating hole or holes or after it has been set and cured therein, another retaining wall block of an appropriate size is laid upwardly in an upper row on the retaining wall block disposed in a lower row so as for the communicating hole or holes to align with the communicating hole or holes of the retaining wall block in the lower row, followed by filling the communicating hole or holes with the filling and setting material and laying another retaining wall block of an appropriate size upwardly in an upper row on the retaining wall block disposed in the lower row. A series of laying the retaining wall blocks, filling the communicating hole or holes of the retaining wall block and laying the retaining wall blocks upwardly in an upper row on the retaining wall block disposed in a lower row is repeated until the retaining wall reaches a predetermined height.

When the filling and setting material is to be filled in the communicating hole or holes of the retaining wall block, the filling and setting material is pressed so as to cause a portion of the filling and setting material to be also filled in the node-shaped cavities and/or the communicating cavities and/or the connecting openings, together with the communicating hole or holes. As the filling and setting material is set and cured therein, the filling and setting material forms node-shaped bodies and/or connecting bodies of the filling and setting material, respectively, which are integrally connected to the communicating hole or holes, thereby integrating the interconnecting configuration of the filling and setting material and providing the retaining wall with improved physical strength against the external forces. It is to be noted herein that the column-shaped bodies or the connecting bodies of the filling and setting material can serve as widening the area of resistance to lateral shear forces so that the retaining wall blocks with the column-shaped bodies and/or the connecting bodies of the filling and setting material formed integrally with the blocks themselves can provide a retaining wall of a rigid structure that can withstand the external forces such as, e.g. the lateral shear forces, etc.

As described above, the column-shaped bodies of the filling and setting material as a rigid structure can ensure the strong resistance against the external forces such as lateral shear forces, etc. as well as against the external forces that cause the retaining wall to slide vertically. The action of the column-shaped bodies of the filling and setting material upon the vertically sliding movement of the retaining wall can be further enhanced when they are formed in association with the connecting bodies connecting the column-shaped bodies. It can be noted that the retaining wall constructed with the retaining wall blocks according to the present invention can be as rigid as a cast-in-place retaining wall.

In a still further specific embodiment of the retaining wall block according to the present invention, the retaining wall block may have additional iron rods disposed in a network or lattice arrangement in the upper depression, thereby improving the physical strength against external forces such as, e.g., lateral shear forces, as well as forces that causes the retaining wall to slide vertically.

The disposition of the additional iron rods in a network or lattice arrangement can also serve as improving the function of aligning the interconnecting iron rods with the retaining wall block to be laid thereon and furthering the reinforcement of the interconnecting iron rods.

The present invention will be described in more detail with reference to the accompanying drawings.

A description will be made of the retaining wall according to the present invention with reference to FIGS. 1 to 3.

Figure 2:
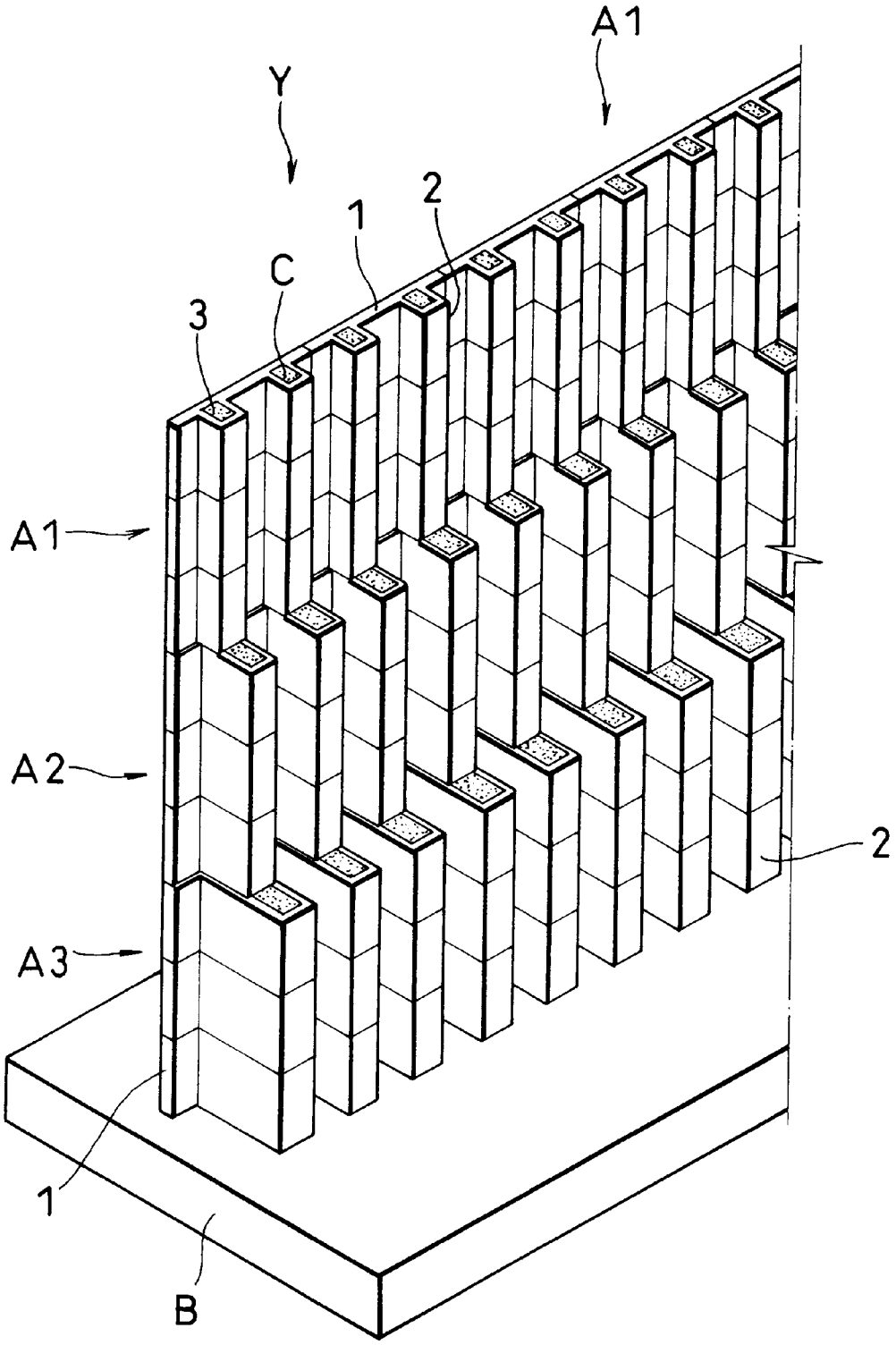
FIG. 2 is a perspective view showing a portion of a retaining wall constructed from retaining wall blocks according to the present invention when viewed from the rear side.
Figure 3:
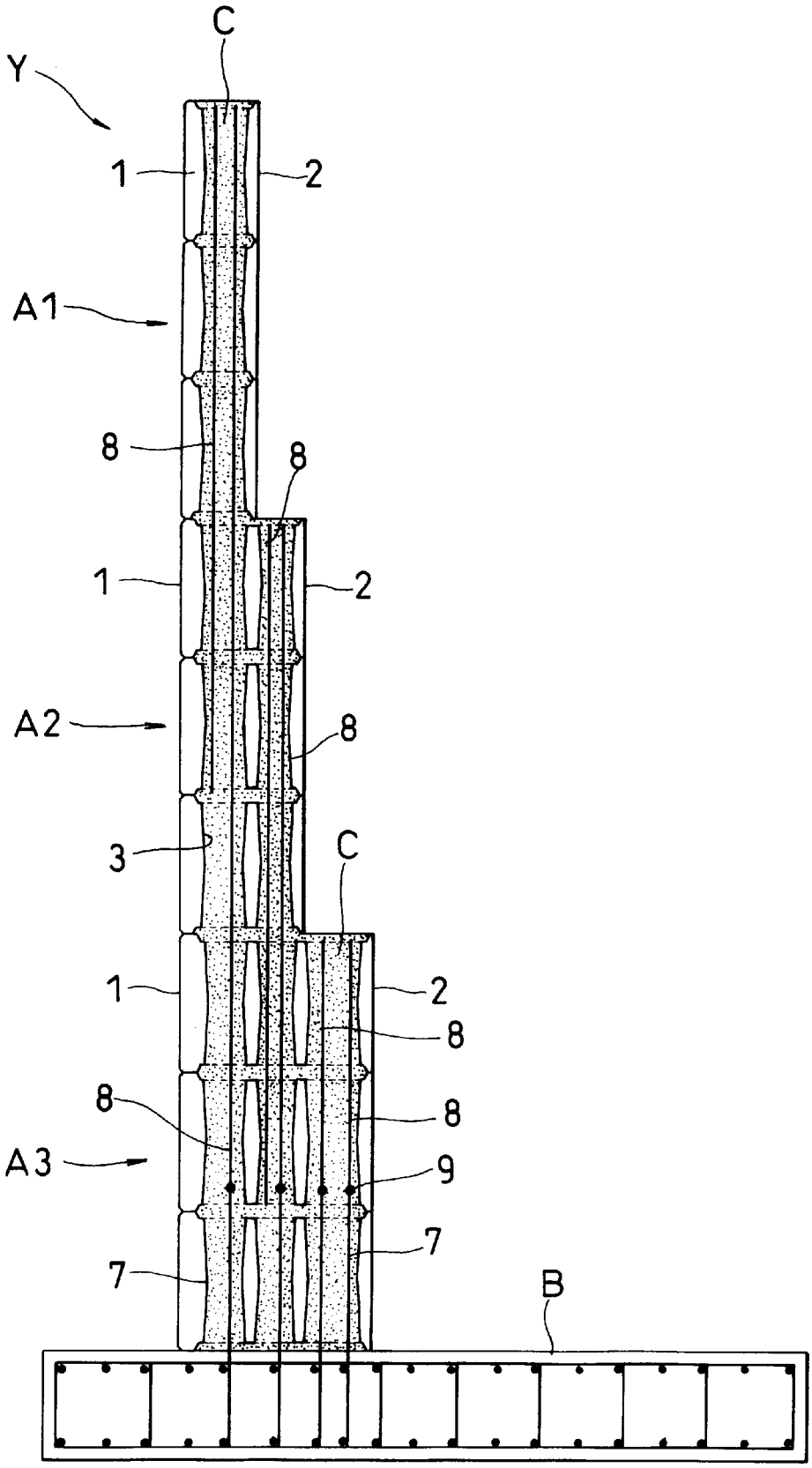
FIG. 3 is a longitudinal side view in cross section showing the retaining wall.

As shown in FIGS. 1 to 3, reference symbol Y stands for a retaining wall which is constructed by laying a number of three kinds of retaining wall blocks A1, A2 and A3 according to the present invention, i.e. small-sized, medium-sized and large-sized retaining wall blocks, respectively, on a footing foundation B. In FIG. 3, reference numeral 7 stands for an anchoring iron rod, reference numeral 8 stands collectively for an interconnecting iron rod, and reference numeral 9 for a binding wire.

More specifically, the retaining wall Y is configured such that the small-sized retaining wall blocks A3 are laid on the footing foundation B in three rows so as for their corresponding communicating holes to align with the reinforcing iron rods disposed on the footing foundation in a spaced relationship at a predetermined interval. On top of the retaining wall block A3 in the third row are laid the medium-sized retaining wall blocks A2 in three rows in substantially the same manner as the retaining wall blocks A3, followed by laying retaining wall blocks Al upwardly in three rows on top of the retaining wall blocks A2 in the uppermost row in substantially the same manner as the rest of the retaining wall blocks, thereby constructing the retaining wall having a predetermined height.

In the description which follows below, it is to be understood that elements provided with reference numerals such as, e.g. partition wall 2, without having no specific symbol representing e.g. left-hand and right-hand, are intended to mean such elements in generic terms, unless otherwise stated or as is apparent from the context of the specification.

Figure 4:
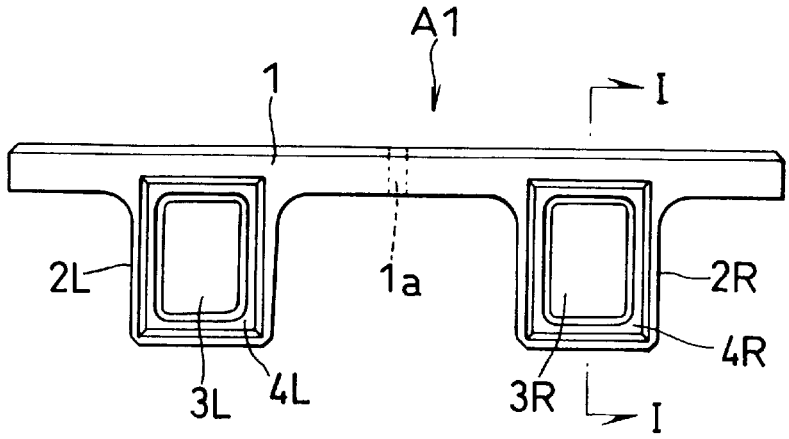
FIG. 4 is a plan view showing a retaining wall block according to a first embodiment of the present invention.
Figure 5:
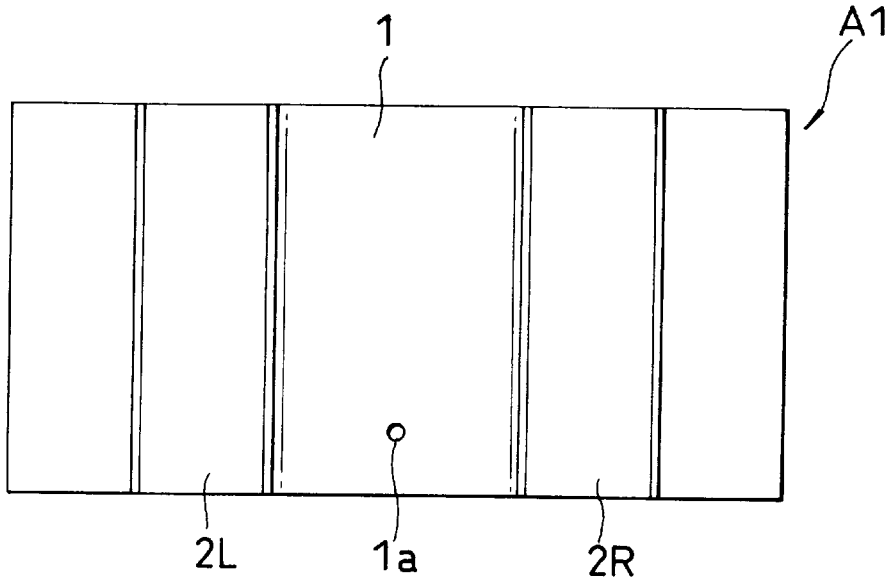
FIG. 5 is a rear view showing the retaining wall block according to the first embodiment of the present invention.

First, a description will be made of the retaining wall block Al with reference to FIGS. 4 to 6.

The retaining wall block Al according to the first embodiment of the present invention basically comprises a front wall 1 and a pair of left-hand and right-hand partition walls 2L and 2R each disposed projecting backwards from the left-hand and right-hand back side portions of the front wall 1, respectively, in which the left-hand partition wall 2L is provided with a left-hand communicating hole 3L extending vertically and the right-hand partition wall 2R is provided with a right-hand communicating hole 2R. In the drawings, reference symbol 1*a* stands for a water drain hole.

Figure 11:
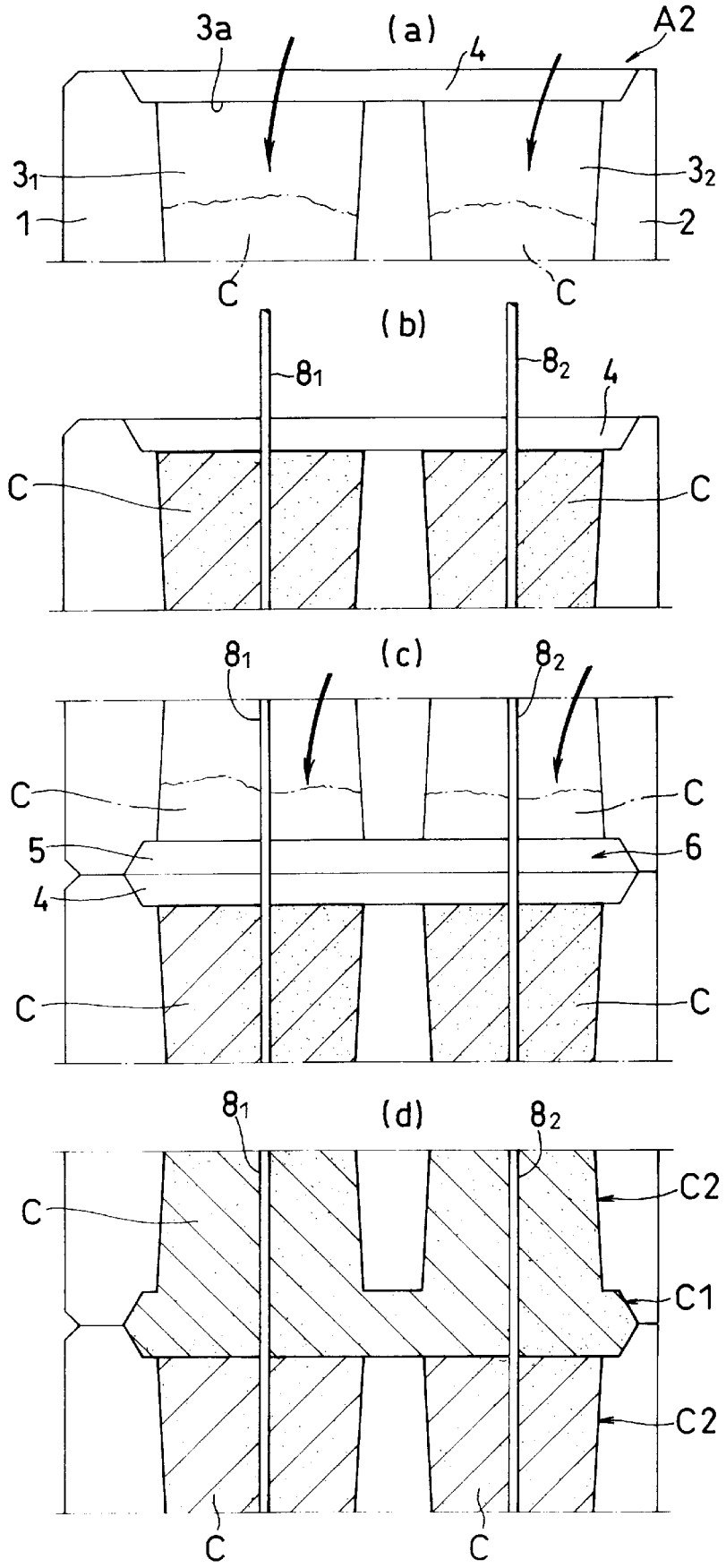
FIG. 11 is a view describing the procedures of filling and setting a filling and setting material when filled in communicating holes of retaining wall blocks laid in plural rows.

Further, the left-hand partition wall 2L is further provided with an upper depression 4L on the top surface thereof and a lower depression 5L on the bottom surface thereof The upper depression 4L is configured in a concave form such that it is enclosed with an upwardly raised edge portion having a flat top surface and it is provided with a communicating hole 3L in a middle portion extending vertically from the top surface to the bottom surface thereof The lower depression SL is likewise configured in a concave form in substantially the same manner as the upper depression 4L when turned upside down. In this configuration of the left-hand partition wall 2L, when a second retaining wall block A1 is laid upwardly on a first retaining wall block A1, the bottom surface of the left-hand partition wall 2 of the second retaining wall block A1 is laid upwardly on the top surface of the left-hand partition wall 2 of the first retaining wall block A1 so as for the upper depression 4L of the first retaining wall block A1 to align with the lower depression SL of the second retaining wall block A1 laid upwardly thereon, thereby forming a node-shaped cavity 6, for instance, as shown in FIG. 11. The right-hand partition wall 2R is configured in substantially the same manner as the left-hand partition wall 2L.

Figure 6:
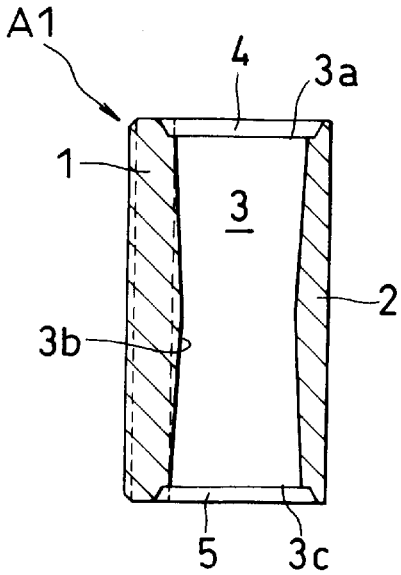
FIG. 6 is a longitudinal side view in cross section showing the retaining wall block according to the first embodiment of the present invention, when taken along line I—I of FIG. 4.

As shown in FIG. 6, the communicating hole 3 may be preferably formed so as for the upper half portion to be gradually tapered inwardly toward the middle portion 3*b* from the top opening portion 3*a* toward the middle portion 3*b* such that the lengthwise diameter of the middle portion 3*b* is less than the lengthwise diameter of the top opening portion 3*a* and furthermore for the lower half portion to be gradually tapered outwardly toward the bottom opening portion 3*c* from the middle portion 3*b* such that the lengthwise diameter of the middle portion 3*b* is less than the lengthwise diameter of the bottom opening portion 3*c*.

Figure 7:
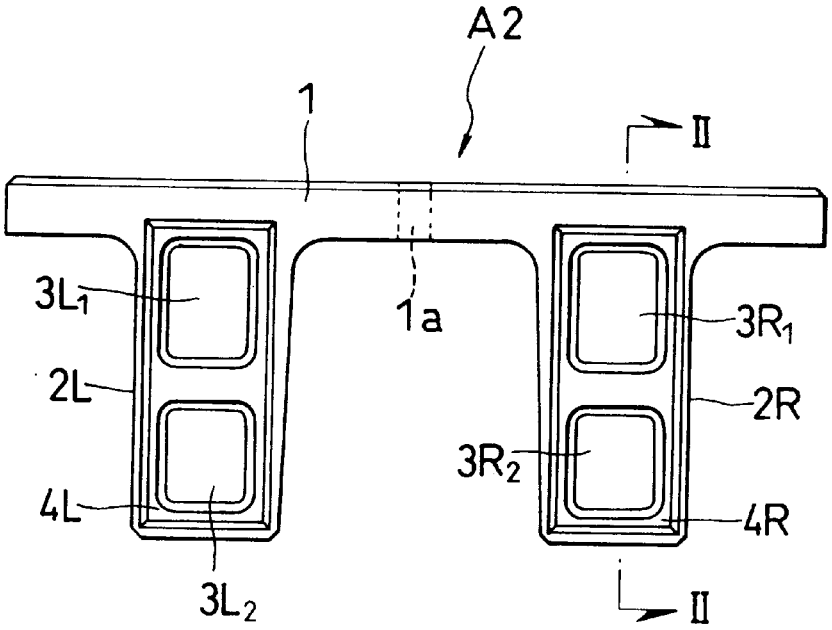
FIG. 7 is a plan view showing a retaining wall block according to a second embodiment of the present invention.
Figure 8:
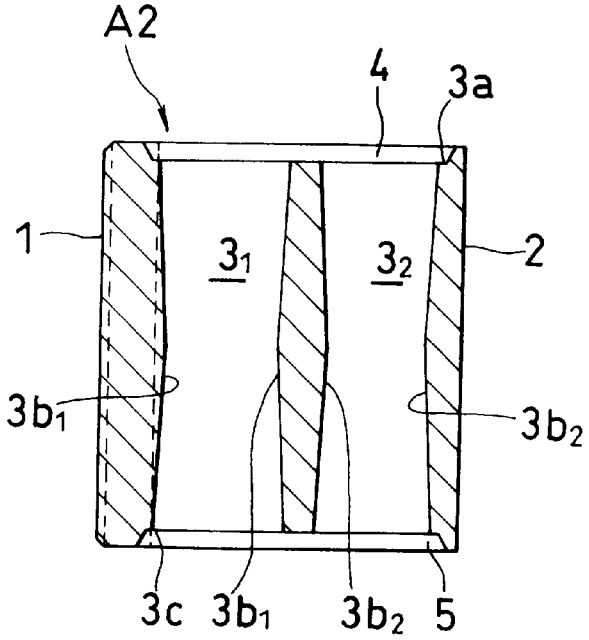
FIG. 8 is a longitudinal side view in cross section showing the retaining wall block according to the second embodiment of the present invention, when taken along line II—II of FIG. 7.

As shown in FIGS. 7 and 8, the retaining wall block A2 according to the second embodiment of the present invention is a medium-size retaining wall block as a variant of the retaining wall block A1 according to the first embodiment of the present invention. The retaining wall block A2 is configured in such a fashion that the retaining wall block A2 has substantially the same basic configuration as the retaining wall block A1 except for the configuration in which the front wall 1 is provided with the left-hand and right-hand partition walls 2L and 2R, which are provided with second communicating holes $3L_2$ and $3R_2$, each extending vertically behind the first communicating holes $3L_1$ and $3R_1$, respectively, which correspond to the communicating holes 3L and 3R formed vertically in the partition walls 2L and 2R of the retaining wall block A1.

Further, as specifically shown in FIG. 8, each of the first communicating hole $3_1$ and the second communicating hole $3_2$ is configured in substantially the same manner as the communicating hole 3 disposed for the retaining wall block A1 as shown in FIG. 6. More specifically, the first communicating hole $3_1$ is formed so as to be gradually tapered inwardly toward the middle portion $3b_1$ from the top opening portion 3*a* such that the lengthwise diameter of the middle portion $3b_1$ is less than the lengthwise diameter of the top opening portion 3*a* and furthermore to be gradually tapered outwardly toward the bottom opening portion 3*c* from the middle portion $3b_1$ such that the lengthwise diameter of the middle portion $3b_1$ is less than the lengthwise diameter of the bottom opening portion 3*c*. Likewise, the second communicating hole $3_2$ is formed so as to be gradually tapered inwardly toward the middle portion $3b_2$ from the top opening portion 3*a* and further to be gradually tapered outwardly toward the bottom opening portion 3*c* from the middle portion $3b_2$.

As shown in FIG. 7, the retaining wall block A2 is further configured such that the left-hand and right-hand partition walls 2L and 2R are provided on their top surfaces with upper depressions 4L and 4R, respectively, in substantially the same manner as the retaining wall block A1. More specifically, the left-hand upper depression 4L is disposed so as to enclose the first and second left-hand communicating holes $3L_1$ and $3L_2$ and the right-hand upper depression 4R is disposed so as to enclose the first and second communicating holes $3R_1$ and $3R_2$. Although not shown in FIG. 7, the left-hand and right-hand partition walls 2L and 2R are provided on their bottom surfaces with lower depressions 5L and 5R, respectively, in substantially the same manner as described immediately above and as the retaining wall block A1.

Figure 9:
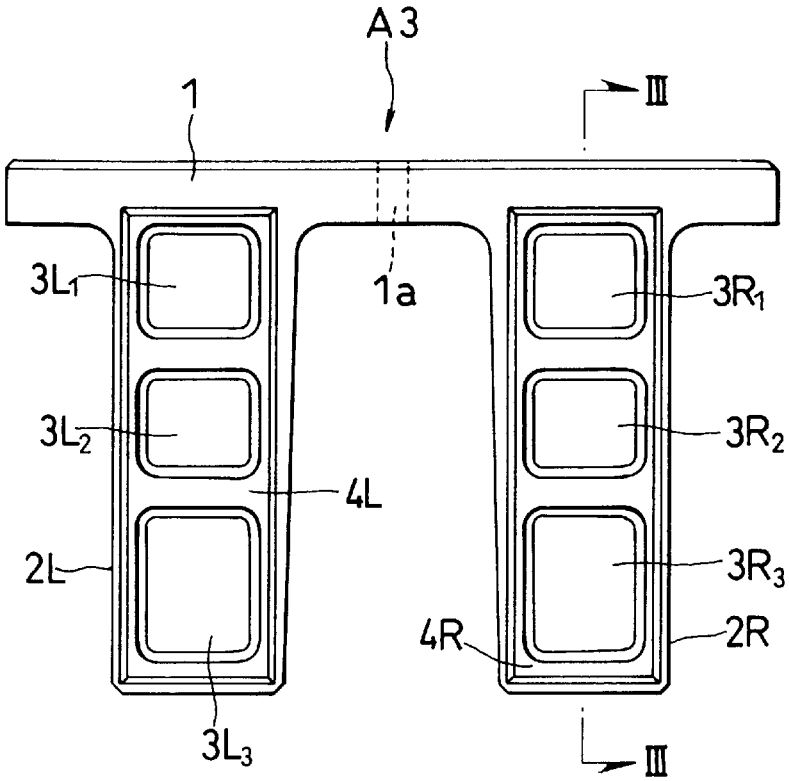
FIG. 9 is a plan view showing a retaining wall block according to a third embodiment of the present invention.

Then, a description will be made of the large-sized retaining wall block A3 with reference to FIGS. 9 and 10. The retaining wall block A3 is configured such that the front wall 1 is integrally formed with left-hand and right-hand partition walls 2L and 2R in substantially the same manner as the retaining wall block A1 and the retaining wall block A2. As shown in FIG. 9, the left-hand partition wall 2L is provided with front and rear sub-partition walls to separate three, i.e. first, second and third, left-hand communicating holes $3L_1$, $3L_2$ and $3L_3$ from each other. The left-hand partition wall 2L is provided on its top surface with an upper depression 4L so as to enclose the top opening portions of the respective communicating holes and on its bottom surface with a lower depression 5L so as to enclose the bottom opening portions thereof Likewise, the right-hand partition wall 2R is provided with three, i.e. first, second and third, right-hand communicating holes $3R_1$, $3R_2$ and $3R_3$ and on its top surface with an upper depression 4L and on its bottom surface with a lower depression 5 (5R) in substantially the same manner as the left-hand partition wall 2L.

Figure 10:
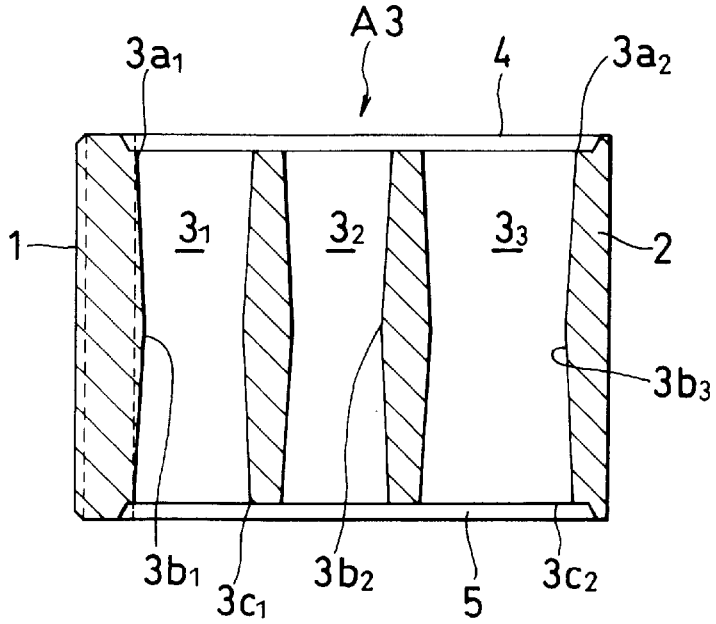
FIG. 10 is a longitudinal side view in cross section showing the retaining wall block according to the third embodiment of the present invention, when taken along line III—III of FIG. 9.

Further, as shown in FIG. 10, each of the first, second and third communicating holes $3_1$, $3_2$ and $3_3$ of the retaining wall block A3 is configured in substantially the same manner as the communicating hole 3 of the retaining wall block A1. More specifically, the first communicating hole $3_1$ is formed so as to be gradually tapered inwardly toward the middle portion $3b_1$ from the top opening portion $3a_1$and further to be gradually tapered outwardly toward the bottom opening portion $3c_1$ from the middle portion $3b_1$ in substantially the same manner as above. Likewise, the second communicating hole $3_2$ is configured in substantially the same manner as above, i.e. it is gradually tapered inwardly toward the middle portion $3b_2$ from the top opening portion $3a_2$ and the top opening portion $3a_2$ and further to be gradually tapered outwardly toward the bottom opening portion $3c_2$ from the middle portion $3b_2$. The third communicating hole $3_3$ is also configured in substantially the same manner as above.

Moreover, as shown in FIGS. 9 and 10, the retaining wall block A3 is configured such that an upper depression 4 is formed and disposed in substantially the same manner as the retaining wall block A2 so as to enclose the opening portions of the three communicating holes 3 and, likewise, a lower depression 5 is formed and disposed in substantially the same manner as the retaining wall block A2, too, so as to enclose the bottom opening portions of the three communicating holes 3.

It is to be understood herein that the numbers of the partition walls, the communicating holes, etc. are not construed in any respect as being limited to those as described above and they may be modified in every and any fashion so as to be adapted to specific constructions in place and that in addition they are described simply as being illustrative of specific embodiments of the configuration of the present invention.

The retaining wall block A2 is further configured such that, when the retaining wall block A1 is laid on the front half portion of the retaining wall block A2, i.e. when the front wall 1 of the retaining wall block A1 is laid on the retaining wall block A2 so as to cause their front surfaces to align with each other, the communicating hole 3 of the retaining wall block A1 can align with the first communicating hole $3_1$ of the retaining wall block A2 and the upper depression 4 of the retaining wall block A2 can also align with the lower depression 5 of the retaining wall block A1.

Further, the retaining wall block A3 is also configured such that, when the retaining wall block A1 is to be laid on the retaining wall block A3 so as for the front surface of the front wall 1 of the retaining wall block A1 to align with the front surface of the front wall 1 of the retaining wall block A3, the communicating hole 3 of the retaining wall block A1 can align with the first communicating hole $3_1$ of the retaining wall block A3 and the bottom depression 5 of the retaining wall block A1 can align with the upper depression 4 of the retaining wall block A3. Likewise, when the retaining wall block A2 is to be laid on the retaining wall block A3 so as to allow the front surface of the front wall 1 of the retaining wall block A2 to align with the front surface of the front wall 1 of the retaining wall block A3, the first and second communicating holes $3_1$ and $3_2$ of the retaining wall block A2 can align with the first and second communicating holes $3_1$ and $3_2$ of the retaining wall block A3 and that the bottom depression 5 of the retaining wall block A2 can align with the upper depression 4 of the retaining wall block A3.

Now, a description will be made of the construction method for constructing a retaining wall Y using three kinds of the retaining wall blocks A1, A2 and A3 with reference to FIGS. 3 and 11–12.

First, the footing foundation B is provided with anchoring iron rods, as indicated collectively as reference numeral 7, so as to project upwardly from the top surface thereof in a spaced relationship such that the anchoring iron rods can be inserted through the communicating holes 3 of a retaining wall block or blocks to be laid on the footing foundation B.

Then, a large-sized retaining wall block A3 is laid singly or plurally in a row on the footing foundation B so as to insert the anchoring iron rods 7 through each of the communicating holes $3_1$, $3_2$ and $3_3$. Thereafter, a retaining wall block A3 is laid singly or plurally in another row on the retaining wall blocks A3 so as for each of the anchoring iron rods 7 to insert through the communicating holes 3. Another row of the retaining wall blocks A3 is laid on the retaining wall blocks A3 laid thereunder so as for each of the anchoring iron rods 7 to insert through the communicating holes 3. The anchoring iron rods 7 are then interconnected, on the one hand, at their lower portions with interconnecting iron rods 8 and, on the other hand, at their upper portions with interconnecting iron rods 9.

After interconnecting, each of the communicating holes 3 of the upwardly laid retaining wall blocks 3A in three rows may be filled with a filling and setting material C and then allowed to set. Alternatively, the filling and setting material C may be filled therein at each time when the retaining wall blocks 3A are laid in a row This alternative way of filling the filling and setting material C is preferred in terms of the easiness with which the filling and setting material C can be fully filled in the communicating holes and the connecting openings. The same thing can be said of the way of filling the filling and setting material in the communicating holes and the connecting openings upon laying the other kinds of the retaining wall blocks.

After the filling and setting material C was filled therein or after it was set and cured therein, a medium-sized retaining wall block A2 is laid singly or plurally in a row on top of the retaining wall block A3 laid in the uppermost row so as to allow the first and second communicating holes $3_1$ and $3_2$ of the retaining wall blocks A2 to upwardly align with the first and second communicating holes $3_1$ and $3_2$ of the retaining wall blocks A3. Medium-sized retaining wall blocks A2 are further laid upwardly in two rows on top of the retaining wall blocks A2 in the lower row in substantially the same manner as the retaining wall blocks A2 are laid on top of the retaining wall blocks A3. Then, interconnecting iron rods 8 are disposed extending upwardly through the first and second communicating holes 3 aligned with the first and second communicating holes 3 of the retaining wall blocks A3 laid thereunder. Alternatively, the interconnecting iron rods 8 may be disposed when the retaining wall blocks A2 is laid in a row in substantially the same manner as the retaining wall blocks A3 are laid in a row or rows.

Thereafter, the filling and setting material C is filled in the first and second communicating holes 3 of the retaining wall blocks A2 aligned with each other at each time when they are laid in a row or in three rows.

After the medium-sized retaining wall blocks A2 are laid in three rows on the retaining wall blocks A3 and the filling and setting material C inserted through the communicating holes 3 of the retaining wall blocks A2 laid in three rows are allowed to set, small-sized retaining wall blocks A1 are laid in three rows on the top surfaces of the retaining wall blocks A2 laid thereunder in substantially the same manner as above so as to allow the communicating holes 3 to align with the first communicating holes $3_1$ of the retaining wall blocks A2 laid thereunder.

Figure 12:
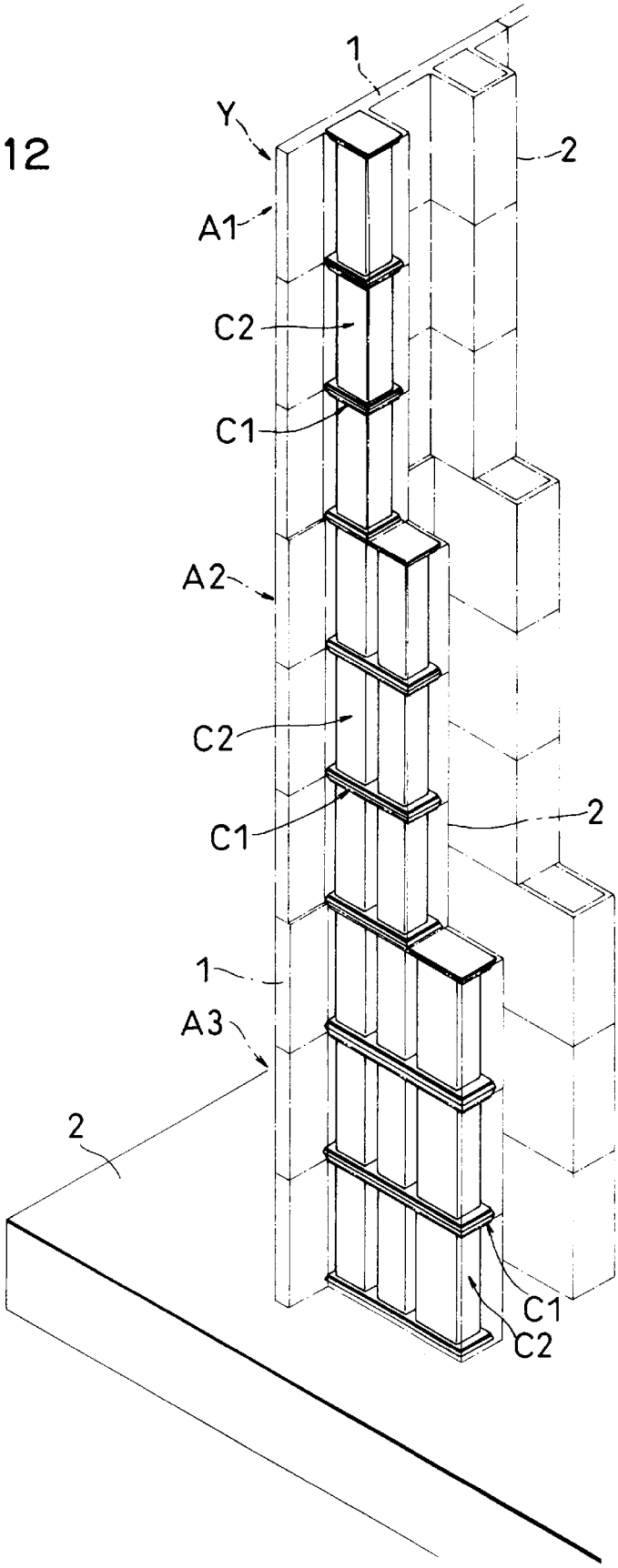
FIG. 12 is a perspective view showing a portion of a construction body comprised of a column-shaped section and a node-shaped section, which is constructed in a manner according to an embodiment of the present invention.

The communicating holes 3 of the retaining wall blocks A1 may be filled with a filling and setting material C at each time when the retaining wall blocks A1 are laid in a row or alternatively in three rows and allowed to set therein to form a retaining wall Y from the large-sized retaining wall blocks A3, medium-sized retaining wall blocks A2 and small-sized retaining wall blocks A1, each laid in three rows, as shown in FIGS. 3, 11 and 12.

As specifically shown in FIGS. 11(*a*) and 11(*b*), the retaining wall block A2 is laid in such a manner that the reinforcing iron rods 8 are inserted and disposed through the respective communicating holes $3_1$ and $3_2$ and then the communicating holes 3 ($3_1$ and $3_2$) are filled with the filling and setting material C up to the top surfaces of the respective communicating holes 3 which in turn is allowed to set. Then, as shown in FIG. 11(*c*), another new retaining wall block A2 is laid on the block A2 disposed in a lower row so as to be aligned with the new retaining wall block A2 laid thereunder and to allow the reinforcing iron rods 8 to be inserted through the respective communicating holes $3_1$ and $3_2$ of the new retaining wall block A2. When the retaining wall blocks A2 in an upper row are laid on top of the retaining wall blocks A2 in a lower row in an appropriate alignment, the upper depression 4 of the lower retaining wall block A2 is likewise aligned with the lower depression 5 of the upper retaining wall block A2 to form a node-shaped cavity 6. Thereafter, the communicating holes $3_1$ and $3_2$ of the upper retaining wall block A2 are filled with a filling and setting material C and allowed to set, as shown in FIG. 11(*d*), thereby constructing a retaining wall having the respective the communicating holes $3_1$ and $3_2$ set forming a column-shaped portion C2 and the node-shaped cavity 6 set forming a node-shaped projection C1.

A retaining wall Y may be constructed as shown in FIG. 12 by laying the retaining wall blocks A3 in three rows on the footing foundation, the retaining wall blocks A2 in three rows on top of the retaining wall blocks A3 in the uppermost row, and the retaining wall blocks A1 in three rows on top of the retaining wall blocks A2 in the uppermost row in substantially the same manner as described above. The retaining wall Y is constructed in a rid structure that can strongly withstand an external force because the column-shaped projection C2 formed by filling the respective communicating holes 3 of the retaining wall blocks A1, A2 and A3 with the filling and setting material C is set integrally with the node-shaped projection C1 formed by filling the respective node-shaped cavities 6 with the filling and setting material C.

Figure 13:
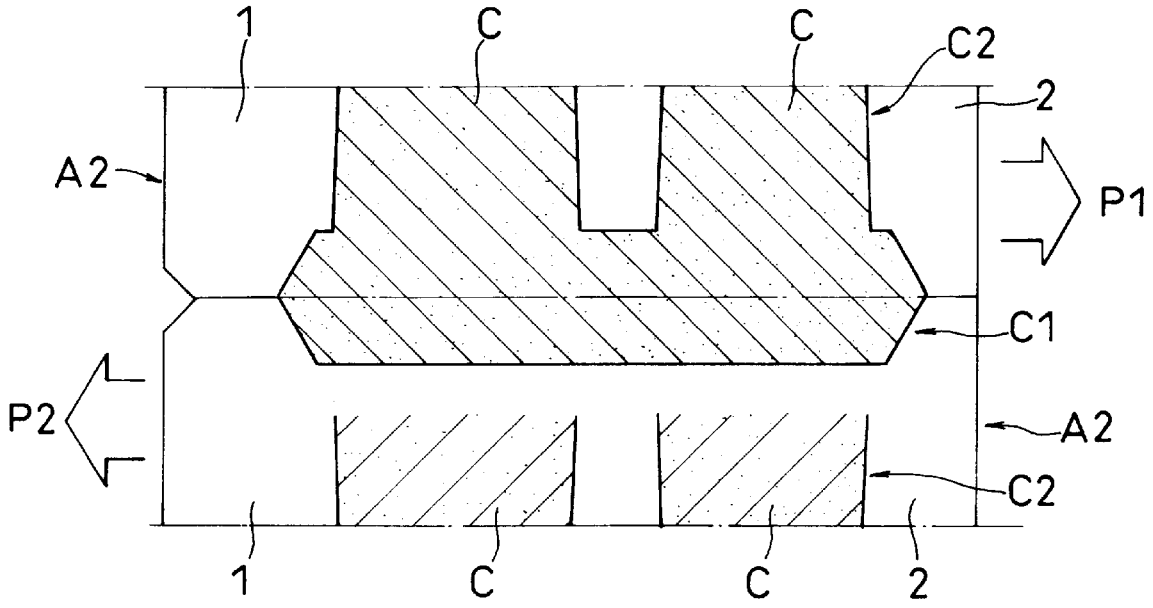
FIG. 13 is a view for describing the action of a lateral shear force upon the step section.

Further, as specifically shown in FIG. 13, the joint surface between the retaining wall block A2 laid on the retaining wall block A2 in the lower row comprises the contact surface between the top surface of the front wall 1 of the lower retaining wall block A2 and the bottom surface of the front wall 1 of the upper retaining wall block A2 and the contact surface between the top edge surface of the partition wall 2 of the lower retaining wall block A2 and the bottom edge surface of the partition wall 2 of the upper retaining wall block A2. Moreover, a cavity formed by the upper depression 4 on the top surface of the lower retaining wall block A2 and the lower depression 5 on the bottom surface of the lower retaining wall block A2 in the middle area of the joint surface is reinforced with the filling and setting material C forming the node-shaped projection C1. The retaining wall Y of this configuration is of a rigid structure in which the retaining wall blocks A2 in the upper and lower rows are integrally united with each other via the node-shaped projection C1 formed therebetween. Therefore, the retaining wall blocks A2 can strongly withstand lateral shear forces P1 and P2 acting upon the joint surface from the side. The resistance of the retaining wall Y against external forces such as, e.g. lateral shear forces can be comparable with that of a cast-in-place retaining wall. Further, the retaining wall Y according to the present invention can offer the advantages that a retaining wall having a wide area can be constructed with ease.

Moreover, as shown in FIG. 3, the filling and setting material C filled through the communicating holes 3 extending upwardly over the entire height of the retaining wall Y is set and cured integrally to form a long column of the set and cured material C. The long column is provided with the node-shaped projection at each of the joints at which the retaining wall blocks are laid in adjacent rows. In addition, the long column comprises a plurality of the column-shaped portions of the set and cured material C each of which is configured such that the upper half section of each column-shaped portion is gradually tapered inwardly so as for the lengthwise diameter is reduced from the top toward the middle portion and the lower half section thereof is gradually tapered downwardly in the opposite way, i.e. so as for the lengthwise diameter is increased from the middle portion toward the bottom. Therefore, in particular, the filling and setting material C set and cured in the column form in the communicating holes 3 of the retaining wall blocks can strongly resist the external forces that cause the set and cured material in the column form to slide upwardly or downwardly in the communicating holes 3 of the retaining wall blocks.

Figure 14:
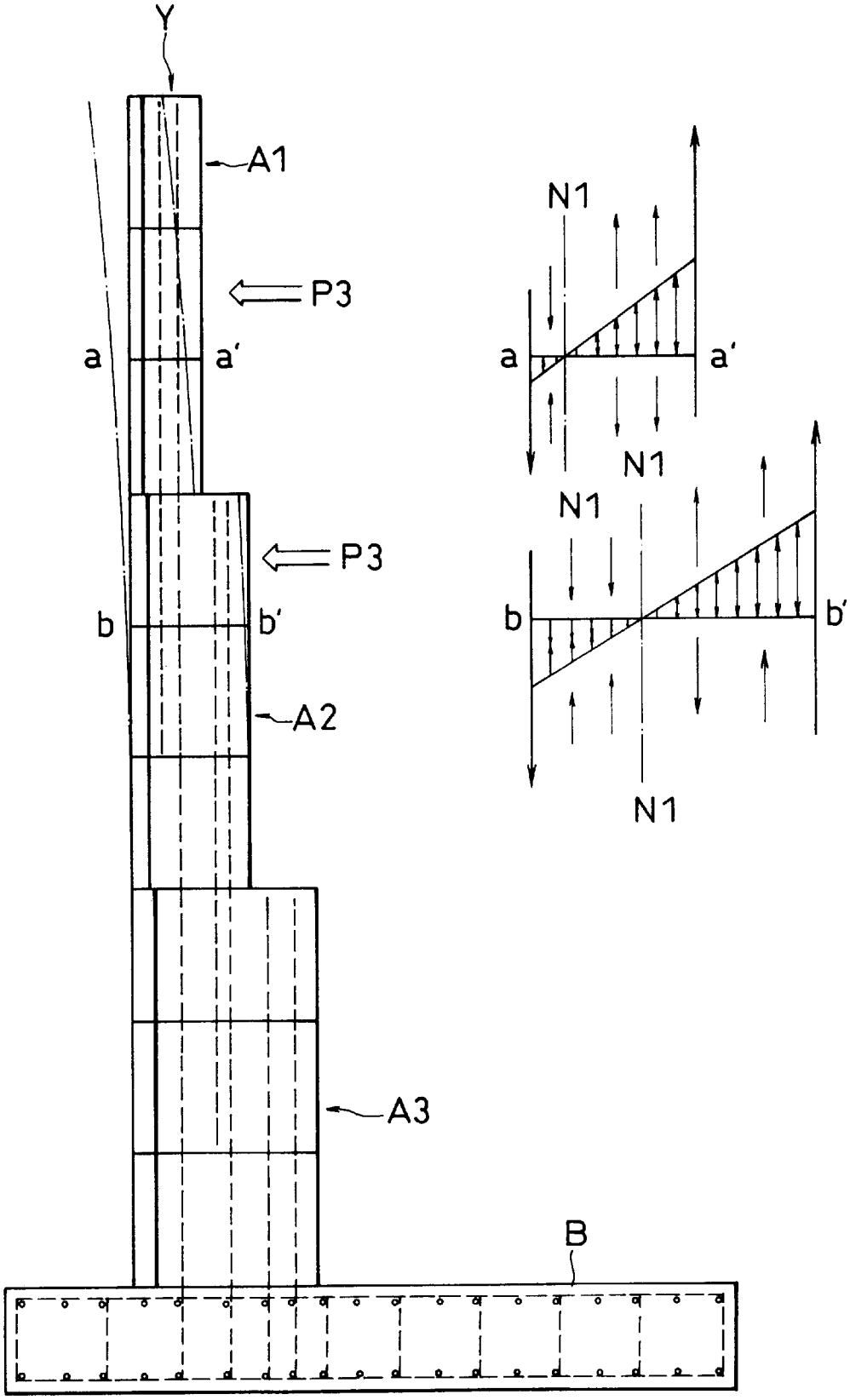
FIG. 14 is a view for describing the action of compressive and tensile forces caused by the external forces acting upon the retaining wall.

More specifically, as shown in FIG. 14, the set and cured material C as a rigid structure can resist the positive bending moment caused by external forces P3 such as earth pressure, etc., acting from the back side toward the front side of the retaining wall Y. At the same time, it can also resist as a rigid structure the negative bending moment by external forces caused, e.g. by earthquake, etc., acting from the front side toward the back side thereof, in such a manner as against the positive bending moment caused at a usual time.

At the same time, the set and cured material C constructed in the structure having the node-shaped projections C1 and the column-shaped portions C2 each having the lengthwise diameter of the intermediate portion of the communicating hole 3 narrower than the lengthwise diameters of the top and bottom portions thereof can assist in reinforcing the strength against the external forces, thereby capable of saving the amount of reinforcing iron rods 8. Therefore, the reinforcing iron rods 8 may be shortened and disposed bridging the joint surfaces of the retaining wall blocks laid in upper and lower rows, thereby maintaining the entire strength of the retaining wall Y against the external forces.

Now, turning to FIG. 14, a description will be made of a neutral axis N1–N1 which is located on a neutral plane that causes neither tensile force nor compressive force. When a T-shaped beam is taken as an example, the neutral axis N1—N1 may be given by the distance X from the front surface of the front wall 1 and, when the compressive stress upon the partition wall of the retaining wall Y is disregarded, it can given by the following formula:

$$X = \frac{2ndAs + bt^2}{2(nAs + bt)}$$

If the compressive stress upon the partition wall of the retaining wall Y is taken into account, the following equation is given:

$$X = \frac{t(b - bo) + nAs}{bo} + \sqrt{\left[\frac{t(b - bo) + nAs}{bo}\right]^2 + \frac{t^2(b - bo) + 2nAsd}{b^0}}$$

where n is a ratio of elasticity coefficient of reinforcing iron rod to elasticity coefficient of concrete, i.e. Es/Ec;

wherein Es is elasticity coefficient of reinforcing iron rod (usually 2,100,000 kg/cm$^2$ (SS41)); and Ec is elasticity coefficient of concrete (usually 140,000 kg/cm$^2$);

b is a width of the front wall;

t is a height of the front wall;

d is a distance from the compressed edge to the center of a tensile iron rod (anchoring, interconnecting iron rods, etc.);

As is a total sectional area of the tensile iron rod; and bo is a width of the partition wall.

Figure 15:
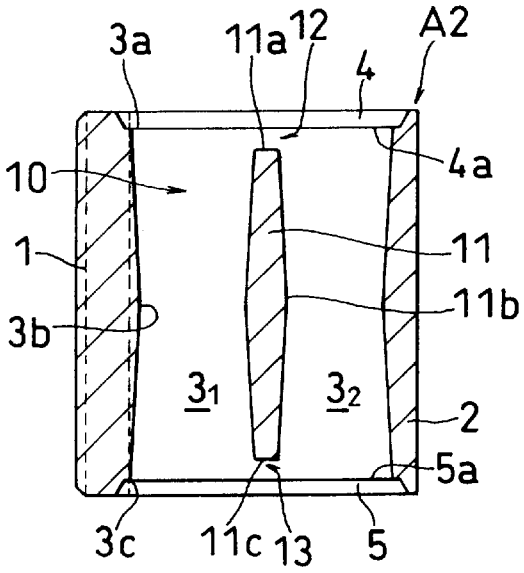
FIG. 15 is a cross-sectional view showing a retaining wall block according to a fourth embodiment of the present invention.

Now, turning to FIG. 15, a description will be made of a medium-sized retaining wall block A2 according to a fourth embodiment of the present invention, which is a variant of the retaining wall block A2 according to the second embodiment. The retaining wall A2 comprises a front wall 1 and a partition wall 2 which is provided with a communicating hole elongating in a lengthwise direction, i.e. from the front side to the rear side, and extending vertically, through which reinforcing iron rods are inserted and disposed. The communicating hole is further provided with a sub-partition wall 11 so as to divide it into two, i.e. front and rear, holes $\mathbf{3}_1$ and $\mathbf{3}_2$, respectively, through which the reinforcing iron rods are inserted and disposed.

Further, the sub-partition wall 11 is disposed such that the top surface 11*a* thereof is located in the position below the bottom surface 4*a* of the upper depression 4 so as to provide a cavity section 12 immediately over the top surface 11*a*, which allows the upper portion of the front hole $\mathbf{3}_1$ to communicate with the upper portion of the rear hole $\mathbf{3}_2$ and that the bottom surface 11*c* thereof is located in the position above the upper surface 5*a* of the lower depression 5 so as to provide a cavity section 13 immediately below the bottom surface 11*c*, which allows the lower portion of the front hole $\mathbf{3}_1$ to communicate with the lower portion of the rear hole $\mathbf{3}_2$.

In the configuration of the retaining wall block A2, when the communicating hole 10, i.e. the front and rear, holes $\mathbf{3}_1$ and $\mathbf{3}_2$, is filled with a filling and setting material C, the communicating cavity sections 12 and 13 are also filled with the filling and setting material C, thereby allowing the upper and lower portions of the front hole $\mathbf{3}_1$ to integrally communicate with the upper and lower portions of the rear hole $\mathbf{3}_2$, respectively. Moreover, the sub-partition wall 11 is gradually tapered inwardly from the top surface 11*a* toward the middle portion 11*b* such that the lengthwise width, i.e., the width extending from the front side to the rear side, of the top surface 11*a* is less than the lengthwise width of the middle portion 11*b* and outwardly from the middle portion 11*b* toward the bottom surface 11*c* such that the lengthwise width of the middle portion 11*b* is larger than the lengthwise width of the bottom surface 11*c*. Therefore, in association of the configuration of the surface of the sub-partition wall 11 facing the inner side wall of the communicating hole $\mathbf{3}_1$, the front communicating hole $\mathbf{3}_1$ is configured such that it is gradually tapered inwardly from the top surface 3*a* toward the intermediate portion 3*b* such that the lengthwise diameter of the communicating hole at the top surface portion is larger than that of the communicating hole at the intermediate portion and outwardly from the intermediate portion 3*b* toward the bottom surface 3*c* such that the lengthwise diameter of the communicating hole at the intermediate portion 3*b* is less than that of the communicating hole at the bottom surface portion 3*c*. The rear communicating hole $\mathbf{3}_2$ is configured in substantially the same manner as the front communicating hole $\mathbf{3}_1$, thereby achieving the same effects as the front communicating hole $\mathbf{3}_1$.

This configuration of the filling and setting material C set and cured in the cavity sections 12 and 13 as well as the communicating holes $\mathbf{3}_1$ and $\mathbf{3}_2$ can further enhance the resistance of the retaining wall against external forces that causes the set and cured material C to slide upwardly or downwardly.

Figure 16:
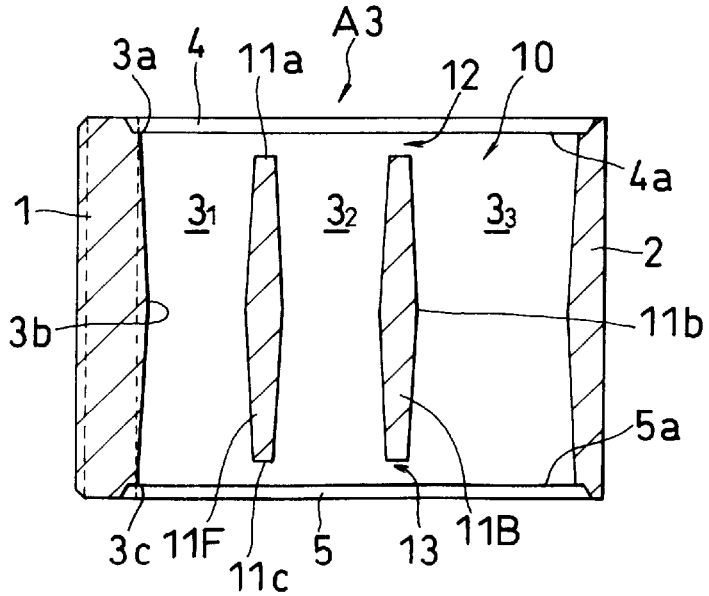
FIG. 16 is a cross-sectional view showing a retaining wall block according to a fifth embodiment of the present invention.

FIG. 16 shows a large-sized retaining wall block A3 according to the fifth embodiment of the present invention, which is a variant of the retaining wall block A3 according to the third embodiment. The retaining wall block A3 has substantially the same basic configuration as the retaining wall block A2 according to the fourth embodiment of the present invention and, more specifically, has a partition wall 2 with a communicating hole which in turn is provided with two, i.e. front and back, sub-partition walls 11F and 11B so as to divide it into three, i.e. front, middle and rear, communicating holes $\mathbf{3}_1$, $\mathbf{3}_2$ and $\mathbf{3}_3$ through each of which a reinforcing iron rod or rods is or are inserted or disposed.

The front and back sub-partition walls 11F and 11B are configured in substantially the same manner as the sub-partition wall 11 disposed in the communicating hole of the retaining wall block A2 according to the fourth embodiment of the present invention as described above. More specifically, the front sub-partition wall 11F is configured in such a manner that the top surface 11*a* is located in the position below the bottom surface 4*a* of the upper depression 4 and the bottom surface 11*c* is located in the position above the upper surface 5*a* of the lower depression 5.

Therefore, a communicating cavity section 12 is formed between the top surface 11*a* and the bottom surface 4*a* so as to allow the upper portion of the front communicating hole $\mathbf{3}_1$ to communicate with the upper portion of the middle communicating hole $\mathbf{3}_2$ and a communicating cavity section 13 is likewise formed between the bottom surface 11*c* and the upper surface 5*a* of the lower depression 5*a* so as to allow the lower portion of the front communicating hole $\mathbf{3}_1$ to communicate with the upper portion of the middle communicating hole $\mathbf{3}_2$. The back sub-partition wall 11B is configured in substantially the same way as the front sub-partition wall 11F. Therefore, a communicating cavity section 12 over the top surface 11*a* of the back sub-partition wall 11B and a communicating cavity section 13 below the bottom surface 11*c* thereof are disposed in substantially the same manner as the retaining wall block A2 according to the fourth embodiment of the present invention.

Further, each of the front and back sub-partition walls 11F and 11B is configured in substantially the same manner as the sub-partition wall 11 of the retaining wall block A2 according to the fourth embodiment of the present invention. In the configuration of each of the front and back sub-partition walls 11F and 11B in association with the front wall 1 and the partition wall 2, each of the three communicating holes $\mathbf{3}_1$, $\mathbf{3}_2$ and $\mathbf{3}_3$ is configured in substantially the same manner as each of the two communicating holes $\mathbf{3}_1$ and $\mathbf{3}_2$ of the retaining wall block A2 according to the fourth embodiment of the present invention. Therefore, the retaining wall blocks A3, when constructed into a retaining wall etc., can demonstrate the same effect as the retaining wall blocks A2 as described above.

Figure 17:
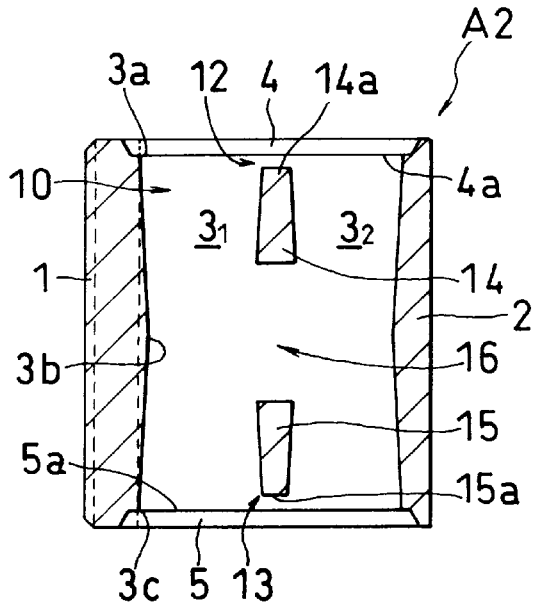
FIG. 17 is a cross-sectional view showing a retaining wall block according to a sixth embodiment of the present invention.

FIG. 17 shows a retaining wall block A2 according to a sixth embodiment of the present invention, which comprises a front wall 1 and a partition wall 2 having a communicating hole 10 elongating in a lengthwise direction, i.e. extending from the front side to the rear side, and extending vertically. The communicating hole is provided with a pair of upper and lower beams 14 and 15, respectively, each bridging and extending transversely between the left-hand and opposed right-hand inner side walls of the partition wall 2, thereby forming a front hole $\mathbf{3}_1$ and a rear hole $\mathbf{3}_2$. The upper beam 14 is configured such that the top surface 14*a* is located in the position below the bottom surface 4*a* of the upper depression 4 so as to form a clearance 14*a* interposed between the top surface 14*a* of the upper beam 14 and the bottom surface 4*a* of the upper depression 4 and such that the bottom surface is located in a spaced arrangement over the top surface of the lower beam 15. On the other hand, the lower beam is configured such that the bottom surface 15*a* is located in the position over the upper surface 5*a* of the lower depression 5 so as to form a clearance 15*a* interposed between the bottom surface 15*a* of the lower beam and the upper surface 5*a* of the lower depression 5. Further, the top surface of the lower beam is located in a spaced arrangement below the bottom surface of the upper beam 14, thereby forming an interconnecting cavity 16 interposed between the bottom surface of the upper beam 14 and the top surface of the lower beam so as to allow the front hole $\mathbf{3}_1$ to communicate with the rear hole $\mathbf{3}_2$. Moreover, the front hole $\mathbf{3}_1$ is allowed to communicate with the rear hole $\mathbf{3}_2$ via the upper clearance 14*a* and the lower clearance 15*a*.

Furthermore, the upper beam 14 is configured in a truncated form in cross-section such that it is gradually tapered downwardly from the top portion 14*a* toward the bottom portion so as for the lengthwise width, i.e. the width extending from the front side to the rear side, of the top surface 14*a* to be less than the lengthwise width of the bottom surface thereof On the other hand, the lower beam is configured in a truncated form in cross-section, as inverted from the truncated form of the upper beam 14, such that it is gradually tapered downwardly from the top portion toward the bottom portion 15*a* so as for the lengthwise width of the top portion to be larger than the lengthwise width of the bottom portion 15*a*. Thus, the front hole $\mathbf{3}_1$ is gradually tapered inwardly toward the top surface 3*a* toward the intermediate portion 3*b* in association of the tapered configuration of the inner back side wall of the front wall 1 such that the lengthwise diameter of the top surface 3*a* is less than the lengthwise diameter of the intermediate portion 3*b*. Likewise, the rear hole $\mathbf{3}_2$ is configured in association with the inner wall of the partition wall 2 in substantially the same manner as the front hole $\mathbf{3}_1$.

When a filling and setting material C is filled in the communicating hole 3, the filling and setting material C is also allowed to penetrate through the interconnecting cavity 16 as well as the upper and lower clearances 14*a* and 15*a* and set and cured to form front and rear columns of the filling and setting material C which are integrally interconnected with the filling and setting material C set and cured through and in the interconnecting cavity 16 and the clearances 14*a* and 15*a*.

Therefore, the configurations of the clearances 14*a* and 15*a* and the middle clearance 16 in association with the tapered beams 14 and can prevent the filling and setting material C set and cured in the front and rear holes $\mathbf{3}_1$ and $\mathbf{3}_2$ from sliding upwardly or downwardly due to the external forces. Moreover, the configurations of this embodiment can effectively prevent the retaining wall blocks of the retaining wall from sliding forwards or backwards leading to collapse of the retaining wall.

Figure 18:
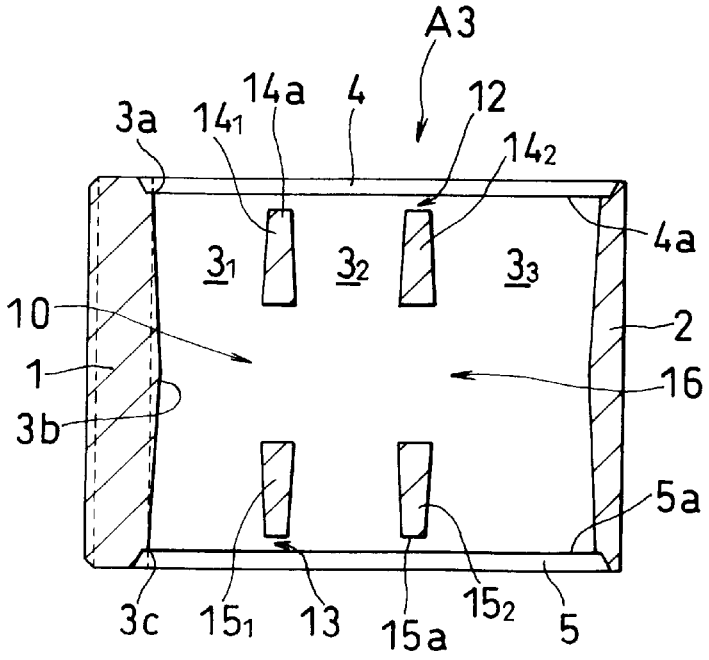
FIG. 18 is a cross-sectional view showing a retaining wall block according to a seventh embodiment of the present invention.

FIG. 18 shows a retaining wall block A3 according to the seventh embodiment of the present invention, which is a variant of the medium-sized retaining wall block A2 according to the sixth embodiment as described above. The retaining wall block A3 comprises a front wall 1 and a partition wall 2 having a communicating hole elongating in a lengthwise direction and extending vertically, which is divided with three, i.e. front, middle and rear, holes $\mathbf{3}_1$, $\mathbf{3}_2$ and $\mathbf{3}_3$ via a front pair of upper and lower beams $\mathbf{14}_1$ and $\mathbf{15}_1$ and a rear pair of upper and lower beams $\mathbf{14}_2$ and $\mathbf{15}_2$. The front pair of the upper beam $\mathbf{14}_1$ and the lower beam $\mathbf{15}_1$ are configured and disposed in substantially the same manner as the pair of the upper beam 14 and the lower beam disposed in the retaining wall block A2 according to the sixth embodiment of the present invention as described above. Likewise, the rear pair of the upper beam $\mathbf{14}_2$ and the lower beam $\mathbf{15}_2$ are configured and disposed in substantially the same manner as the front pair of the upper beam $\mathbf{14}_1$ and the lower beam $\mathbf{15}_1$ of the retaining wall block A3 as described immediately above.

When a filling and setting material C is filled in the communicating hole 3 of the retaining wall block A3 according to the seventh embodiment, the filling and setting material C is also allowed to penetrate through the middle clearance 16 formed between the bottom surface of the upper beam 14 and the top surface of the lower beam as well as the upper and lower clearances 14*a* and 15*a* and set and cured to form front and rear columns of the filling and setting material C which are integrally interconnected with the filling and setting material C set and cured through and in the middle clearance 16 and the clearances 14*a* and 15*a*.

Therefore, the configurations of the clearances 14*a* and 15*a* and the middle clearance 16 in association with the pairs of the tapered beams 14 and can prevent the filling and setting material C set and cured in the front, middle and rear holes $3_1$, $3_2$ and $3_3$ from sliding upwardly or downwardly due to the external forces, like the retaining wall block A2 according to the sixth embodiment. Moreover, likewise, the configurations can effectively prevent the retaining wall blocks of the retaining wall from sliding forwards or backwards leading to collapse of the retaining wall.

It is to be understood as a matter of course that the retaining wall block according to the present invention is not construed in any respect as being limited to the retaining wall blocks according to the previous embodiments as described above and compassing any modifications and variations within the scope and spirit of the present invention. For instance, the retaining wall block may be provided with four or more communicating holes 3 in substantially the same manner as described above.

Figure 19:
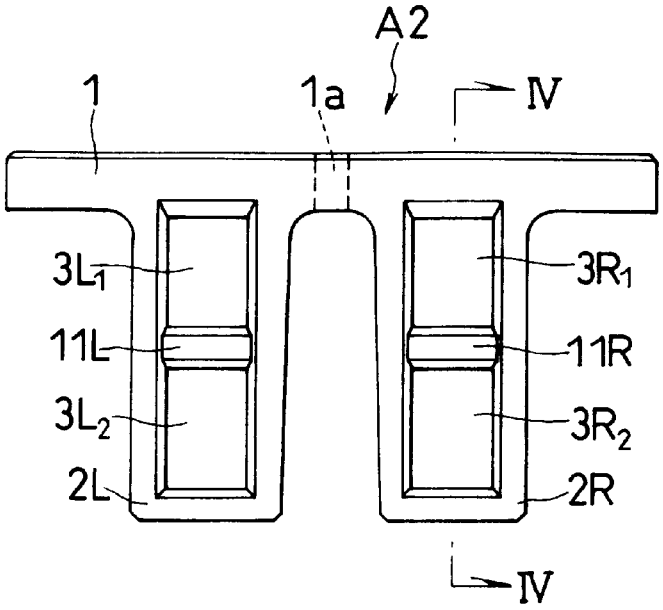
FIG. 19 is a plan view showing a retaining wall block according to an eighth embodiment of the present invention.
Figure 20:
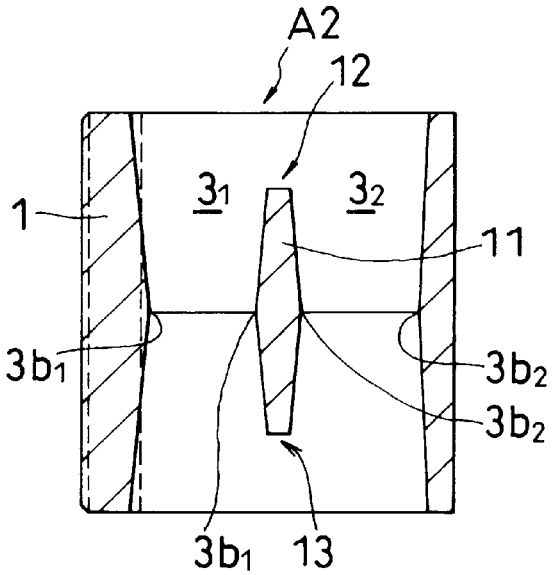
FIG. 20 is a cross-sectional view showing the retaining wall block according to the eighth embodiment of the present invention, when taken along line IV—IV of FIG. 19.

FIGS. 19 and 20 show a retaining wall block A2 according to the eighth embodiment of the present invention, which is provided with no upper and lower depressions 4 and 5 as in the retaining wall blocks A2 according to the previous embodiments. The retaining wall block A2 according to the eight embodiment may comprise a front wall 1 and left-hand and right-hand partition wall 2L and 2R. The left-hand partition wall 2L is provided with two, i.e. front and rear, communicating holes $3L_1$ and $3L_2$ and a lateral beam 11L bridging and interposed between the left-hand and opposed right-hand inner side walls thereof The lateral beam 11L is configured such that the top surface thereof is located in a relationship spaced apart from the top surface of the partition wall 2L to a upper clearance 12 and the bottom surface thereof is located in a relationship spaced apart from the bottom surface of the partition wall 2L to form a lower clearance 13. The upper clearance 12 allows the upper portion of the front communicating hole $3_1$ to communicate with the upper portion of the rear communicating hole $3_2$ and likewise the lower clearance 13 allows the lower portion of the front hole $3_1$ to communicate with the lower portion of the rear hole $3_2$. The upper and lower clearances 12 and 13 of the retaining wall block A2 according to this embodiment are formed so as to be larger than the upper and lower clearances 12 and 13 of the retaining wall block A2 according to the previous embodiments. The right-hand partition wall 2R is configured in substantially the same manner as the left-hand partition wall 2L.

Further, the beam 11 of the retaining wall block A2 of this embodiment is gradually tapered inwardly from the top surface toward the middle portion $3b_1$ such that the lengthwise width of the top portion is less than the lengthwise width of the middle portion and tapered downwardly from the middle portion toward the bottom portion such that the lengthwise width of the middle portion is larger than the lengthwise width of the bottom portion. Therefore, the front communicating hole $3_1$ may be gradually tapered inwardly from the top opening portion toward the middle portion $3b_1$such that the lengthwise diameter at the top surface portion is larger than the lengthwise diameter at the middle portion $3b_1$ and downwardly from the middle portion toward the bottom opening portion such that the lengthwise diameter at the middle portion is less than the lengthwise diameter at the bottom opening portion. On the other hand, the rear communicating hole $3_2$ may be configured in substantially the same manner as the front communicating hole $3_1$.

In the configuration of the retaining wall block A2 as described above, a filling and setting material C can be filled and cured in the front and rear communicating holes $3_1$ and $3_2$ as well as through the upper and lower cavity sections 12 and 13 to form two column-shaped bodies of the set and cured material C interconnected integrally with two lateral bodies of the set and cured material C in the upper and lower cavity sections 12 and 13. The interconnection of the set and cured material C through and in the communicating holes 3 as well as the interconnecting cavities 16 and the upper and lower clearances 12 and 13 can strongly withstand lateral shear forces acting from the side of the retaining wall.

Figure 21:
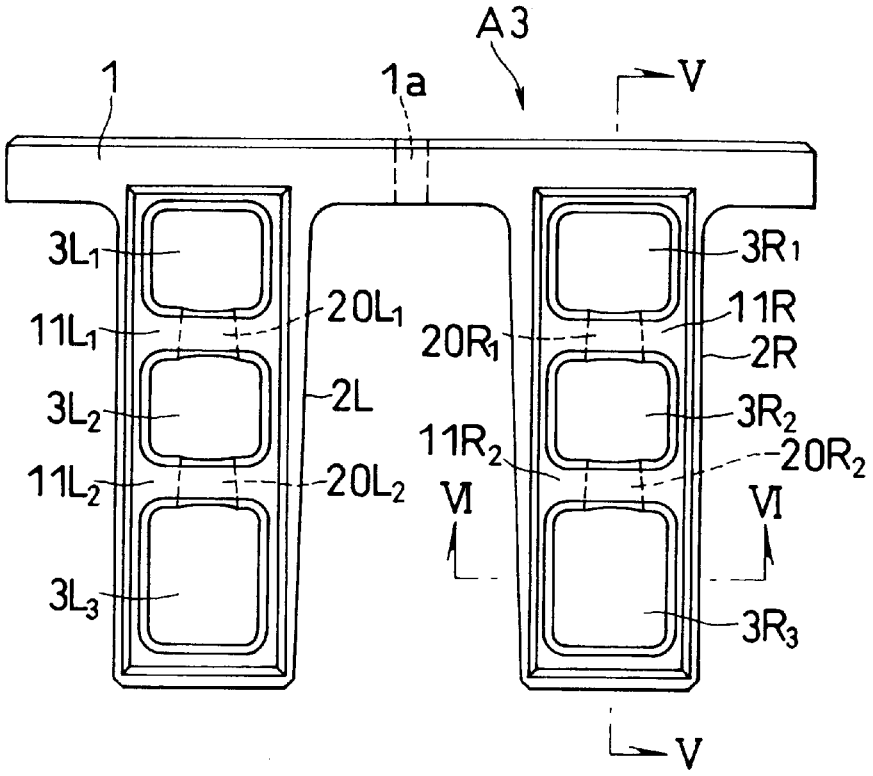
FIG. 21 is a plan view showing a retaining wall block according to a ninth embodiment of the present invention.
Figure 22:
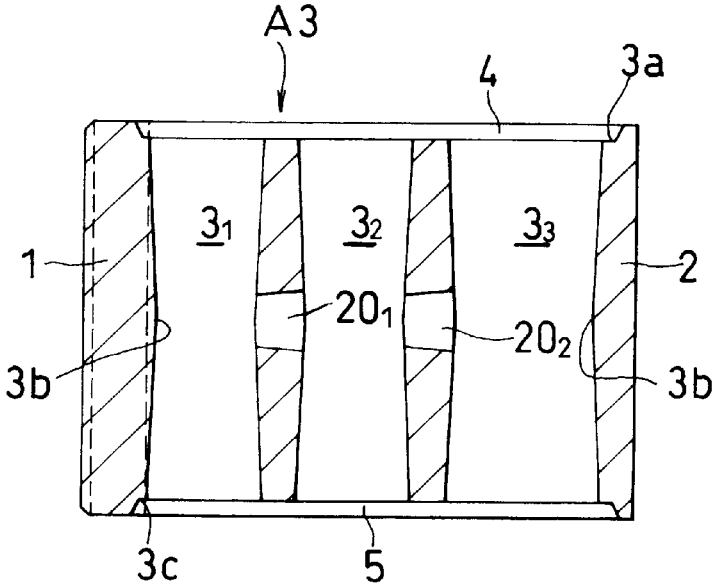
FIG. 22 is a cross-sectional view showing the retaining wall block according to the ninth embodiment of the present invention, when taken along line V—V of FIG. 21.
Figure 23:
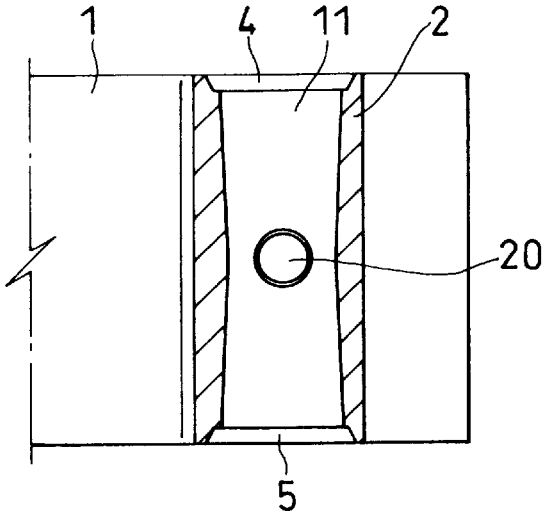
FIG. 23 is a cross-sectional view showing the retaining wall block according to the ninth embodiment of the present invention, when taken along line VI—VI of FIG. 21.

FIGS. 21 through 23 show a large-sized retaining wall block A3 according to the ninth embodiment of the present invention, which has substantially the same basic configuration as the large-sized retaining wall block A3 according to the third embodiment as described above. More specifically, the left-hand partition wall 2L comprises a front wall 1 and left-hand and right-hand partition walls 2L and 2R. The left-hand partition wall 2L is provided with three, i.e. front, middle and rear, communicating holes $3L_1$, $3L_2$ and $3L_3$, respectively, and with an upper depression 4L and a lower depression 5L. The front, middle and rear communicating holes $3L_1$, $3L_2$ and $3L_3$ are each separated by front and rear partition walls $11L_1$ and $11L_2$, respectively, which in turn is configured in substantially the same manner as the sub-partition walls of the retaining wall block A3 as shown in FIGS. 9 and 10. The front and rear partition walls $11L_1$ and $11L_2$ are further provided with front and rear interconnecting holes $20L_1$ and $20L_2$, respectively. More specifically, the front interconnecting hole $20L_1$ allows the intermediate portion of the front communicating hole $3L_1$ to communicate with the intermediate portion of the middle communicating hole $3L_2$ and the rear interconnecting hole $20L_2$ allows the intermediate portion of the middle communicating hole $3L_2$ to communicate with the intermediate portion of the rear communicating hole $3L_3$.

When a filling and setting material C is filled in the communicating holes 3 of the retaining wall block A3 according to the ninth embodiment as described above, it is allowed to penetrate through the interconnecting holes $20L_1$ and $20L_2$ and set and cured therein to form an interconnected body of the set and cured material C consisting of three column-shaped body sections and two interconnected sections. The interconnection of the set and cured material C through and in the communicating holes 3 and the interconnecting holes $20L_1$ and $20L_2$ can strongly withstand external forces that cause the retaining wall blocks to slide upwardly or downwardly.

It is to be noted herein that the present invention is not limited in any respect to the specific number and position of the interconnecting holes and they may be varied in an appropriate way so as to adapt to the embodiments of the present invention.

Figure 24:
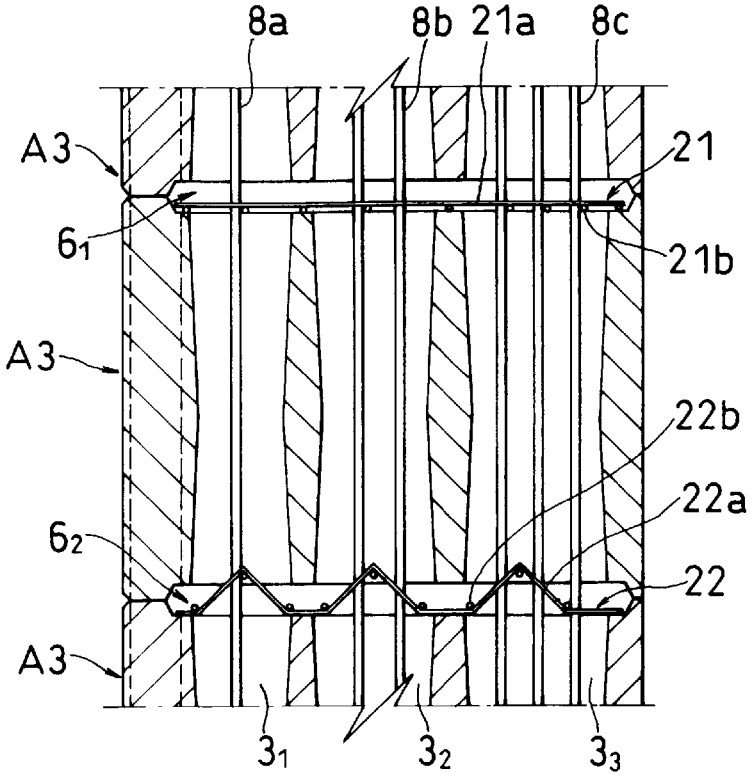
FIG. 24 is a view in cross section showing an assembly of retaining wall blocks with first and second additional iron bars disposed therebetween.
Figure 25:
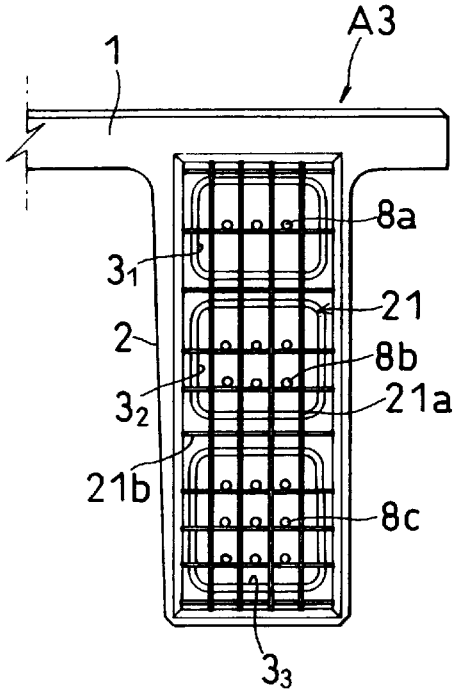
FIG. 25 is a partial view showing the disposition of the first additional iron bars.
Figure 26:
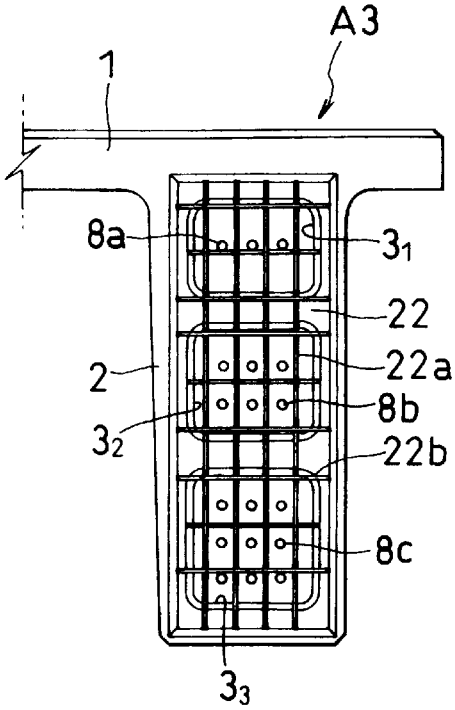
FIG. 26 is a partial view showing the disposition of the second additional iron bars.

FIGS. 24 through 26 show an embodiment of the disposition of first additional interconnecting iron rods 21 in the node-shaped cavity $6_1$ formed by the middle retaining wall blocks A3 of the third embodiment laid under the upper retaining wall blocks A3 of the same configuration and second additional interconnecting iron rods 22 in the node-shaped cavity $6_2$ formed by the middle retaining wall blocks A3 laid over the lower retaining wall blocks A3 of the same configuration.

The first additional interconnecting iron rods 21 may comprise a network or lattice structure of a plurality of interconnecting iron rods 21*a* disposed longitudinally, i.e. in to-and-fro directions, and a plurality of interconnecting iron rods 21*b* disposed laterally, i.e. in left-and-right directions. The first additional interconnecting iron rods 21 may be disposed in a network or lattice configuration in the upper depression 4 of the retaining wall block A3.

Further, the second additional interconnecting iron rods 22 may comprise a network or lattice structure of a plurality of interconnecting bent-up iron rods 22*a* having the portions corresponding to the communicating holes $3L_1$, $3L_2$ and $3L_3$ curved upwardly and a plurality of interconnecting iron rods 22*b* disposed laterally. The second additional interconnecting iron rods 22 may be further disposed in a network or lattice configuration in the upper depression 4 of the retaining wall block A3.

The disposition of the first and second additional interconnecting iron rods 21 and 22 in the node-shaped cavity 6 can further reinforce the resistance to external forces such as, e.g. lateral shear forces, etc., when a filling and setting material C is filled in the node-shaped cavity 6 through the communicating holes 3 of the retaining wall blocks of a retaining wall and the filling and setting material C is allowed to set therein forming the node-shaped body C1.

In particular, the interconnecting bent-up iron rods 22*a* of the second additional interconnecting iron rods 22 can contribute to the reinforcement against the external forces such as lateral shear forces, etc.

Further, the first and second additional interconnecting iron rods 21 and 22 disposed in a network or lattice configuration can serve as positioning the interconnecting iron rods 8*a*, 8*b* and 8*c* disposed in the communicating holes $3_1$, $3_2$ and $3_3$, respectively, and at the same time as reinforcing the interconnecting iron rods 8*a*, 8*b* and 8*c*.

In this embodiment, the first and second additional interconnecting iron rods 21 and 22 are disposed together in the upper depression 4. It is to be noted that they may be used at an appropriate location singly or plurally in accordance with the magnitude of external forces such as earth pressure, etc.

Figure 27:
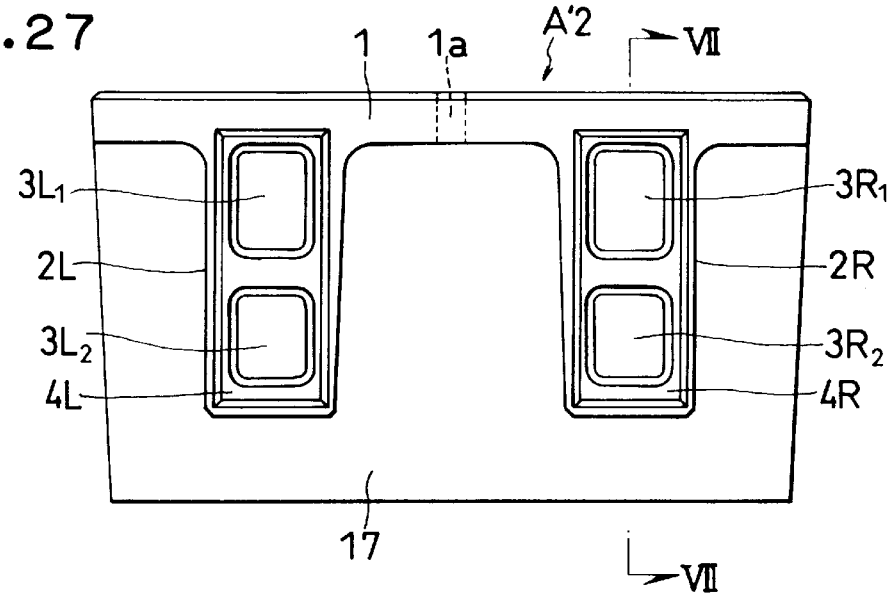
FIG. 27 is a plan view showing a retaining wall block according to a tenth embodiment of the present invention.
Figure 28:
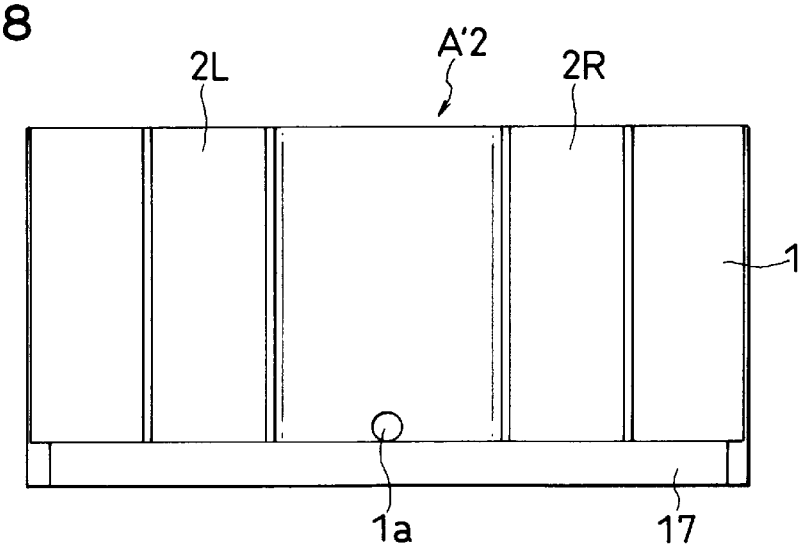
FIG. 28 is a rear view showing the retaining wall block according to the tenth embodiment of the present invention.
Figure 29:
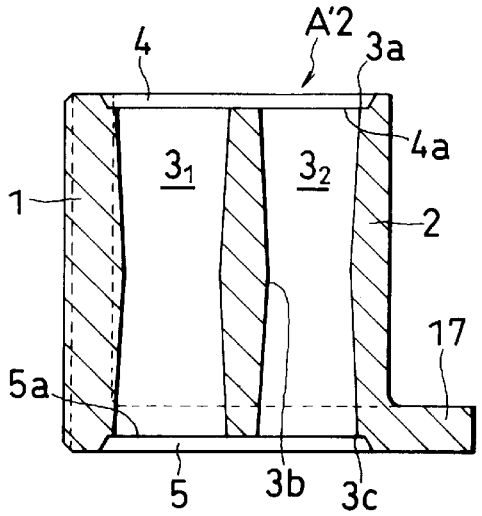
FIG. 29 is a longitudinal side view in cross-section showing the retaining wall block according to the tenth embodiment of the present invention, when taken along line VII—VII of FIG. 27.

FIGS. 27 through 29 show a medium-sized retaining wall block A'2 according to the tenth embodiment of the present invention, which has substantially the same basic configuration as the retaining wall block A2 according to the second embodiment. The retaining wall block A'2 comprises a front wall, left-hand and right-hand partition walls 2L and 2R as well as a bottom plate 17. The bottom plate 17 may be configured in such a manner that it extends from the bottom portion of the rear surface of the front wall 1 backwards in parallel to the partition walls 2L and 2R and ends in the position generally equal to or behind the rear ends of the partition walls 2L and 2R.

Figure 30:
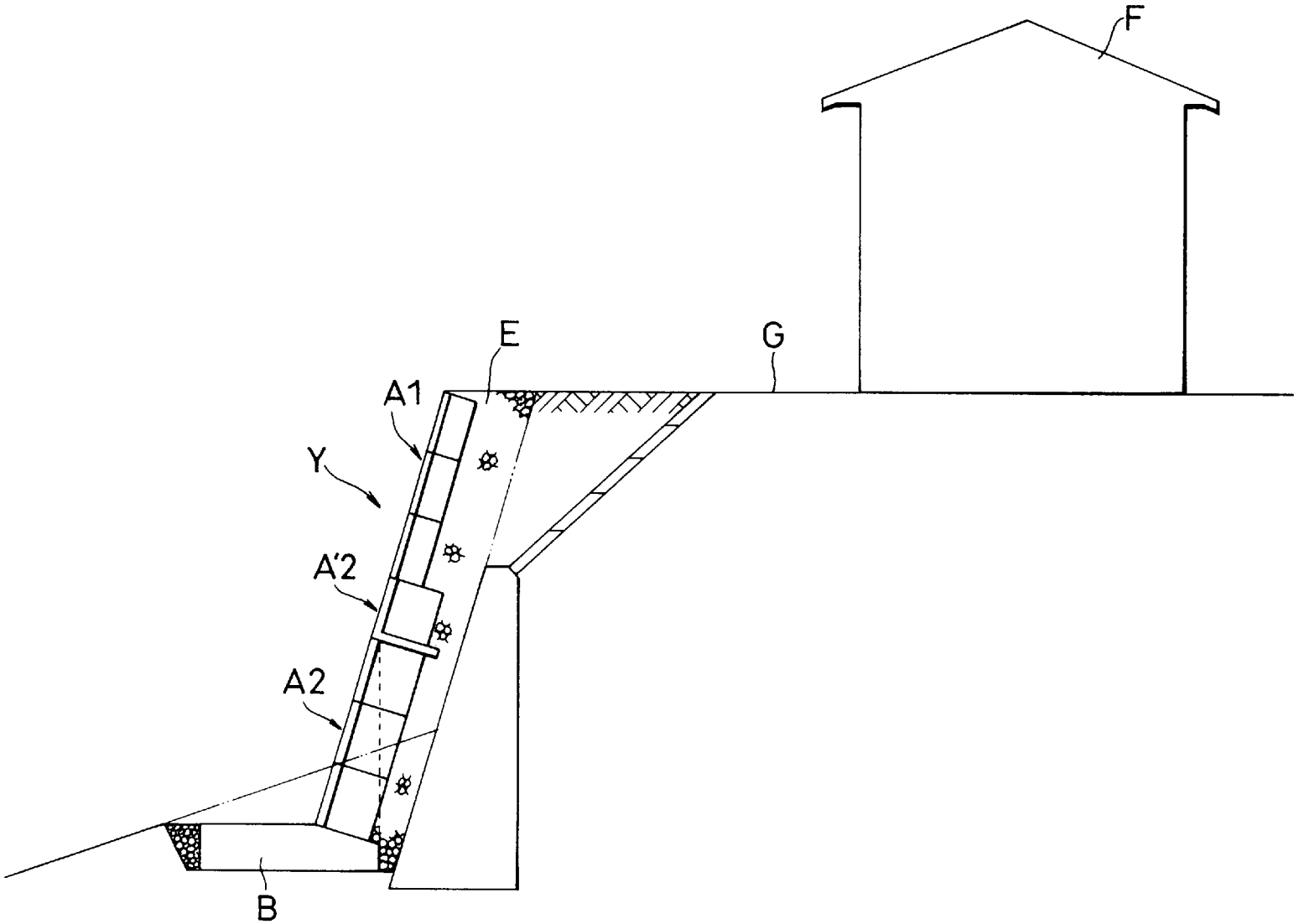
FIG. 30 is a schematic view showing a retaining wall system constructed using the retaining wall blocks according to the tenth embodiment of the present invention.

As specifically shown in FIG. 30, the retaining wall blocks A'2 may be preferably disposed at least at an intermediate portion of a retaining wall Y and a backfilling material E is placed on the bottom plate 17 to allow the action upon the bottom plate 17 as a load that causes the retaining wall block A'2 to be inclined backwards, thereby creating a negative rotation moment so as to cause the retaining wall Y to fall down or turn over toward the rear surface side thereof and increasing the moment of resistance to overturning by the amount corresponding to the negative rotation moment to improve an overturning safety factor and ensuring the safety of the retaining wall Y to a favorable extent.

Further, as the backfilling material E can act upon the bottom plate 17 as a load, the vertical load of the retaining wall Y as a whole can be increased, thereby enabling to elevate friction at each portion of the retaining wall and to improve the safety against the sliding movement of the retaining wall Y As a result, the retaining wall blocks according to the present invention can make the area of the footing foundation B smaller and consequently the area of a site for constructing a retaining wall and other construction bodies. Further, the smaller areas of the footing foundation B and the constructing site can shorten the period of construction and save costs of construction to a great extent.

Therefore, as shown in FIG. 30, even if a road G or other construction is built in a location close to or adjacent houses or other existing buildings F, the footing foundation B can be constructed without contact with the foundation of the buildings, etc. and a predetermined cross-sectional dimension can be ensured.

It is to be noted herein that the length of the backwards extension of the bottom plate 17 is not limited to the particular one as described above and can be shortened or lengthened appropriately as long as the bottom plate 17 can support and withstand the load of the backfilling material E while it can achieve the desired effects. Moreover, it is to be noted herein that any of the retaining wall blocks A1 and A3 according to the previous embodiments of the present invention can also be provided with the bottom plate 17 in substantially the same manner.

Figure 31:
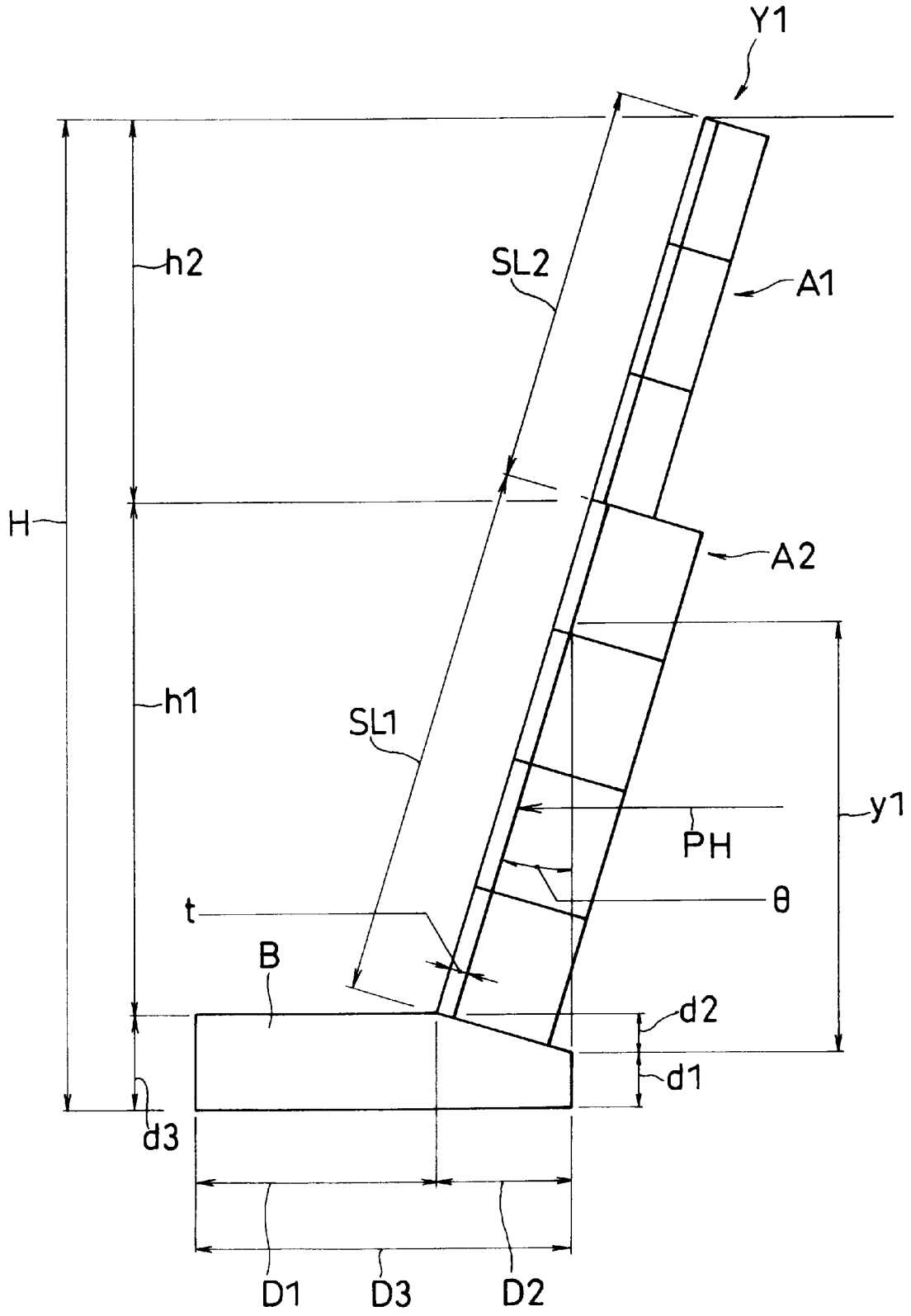
FIG. 31 is a schematic view showing a retaining wall system constructed using the retaining wall blocks according to the first embodiment of the present invention, in combination with the retaining wall blocks according to the second or third embodiment of the present invention.
Figure 32:
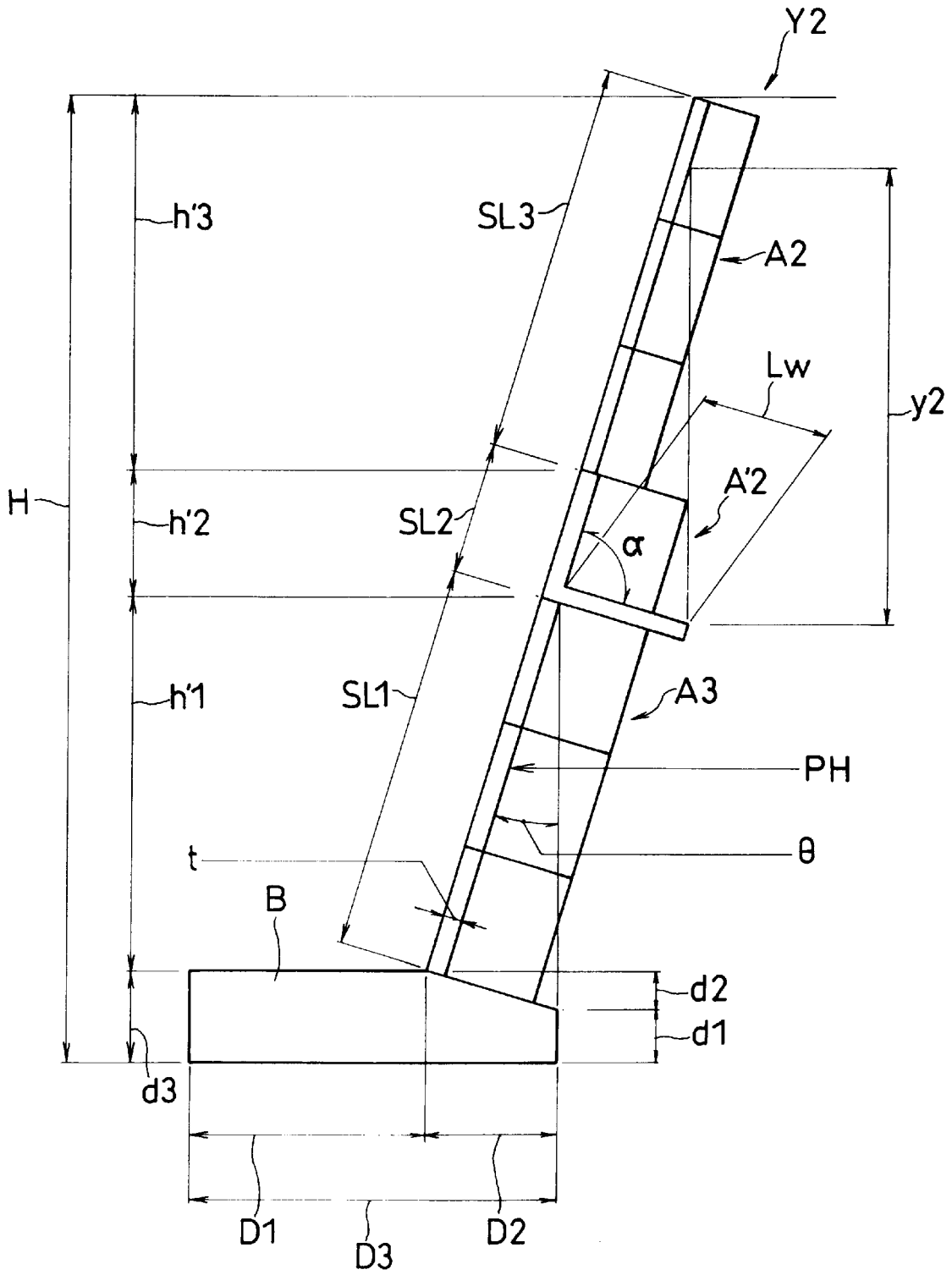
FIG. 32 is a schematic view showing a retaining wall system constructed using the retaining wall blocks according to the first embodiment of the present invention, in combination with the retaining wall blocks according to the tenth embodiment of the present invention.

Now, a description will be made of the computation of stability of a retaining wall constructed with the retaining wall blocks according to the present invention each as shown in FIGS. 31 and 32. The retaining wall Y1 as shown in FIG. 31 is a retaining wall constructed with the retaining wall blocks A1, A2 and A3 according to the first, second and third embodiments of the present invention and the retaining wall Y2 as shown in FIG. 32 is a retaining wall constructed with the retaining wall blocks A1, A2, A3 and A'2 according to the first, second, third and tenth embodiments of the present invention, respectively. The computation conditions will be illustrated in Table 1 below.

TABLE 1

| ITEMS | SYMBOL | VALUE | UNIT |
|---|---|---|---|
| Weight of retaining wall block A1 | Mw | 0.635 | $t/m^2$ |
| Distance from compressive edge to gravity of retaining wall block A1 | MGX | 0.200 | m |
| Weight of retaining wall block A2 | Bw | 0.991 | $t/m^2$ |
| Distance from compressive edge to gravity of retaining wall block A2 | BGX | 0.357 | m |
| Weight of retaining wall block A'2 | B'w | 1.203 | $t/m^2$ |
| Distance from compressive edge to gravity of retaining wall block A'2 | B'GX | 0.413 | m |
| Thickness of bottom plate of retaining wall block A'2 | $t_0$ | 0.120 | m |
| Angle of inclination of rear plane of retaining wall with respect to vertical plane | θ | 16.699 | ° |
| Thickness of front wall of retaining wall block A2 | t | 0.120 | m |
| Distance between ob' on heel plate of footing foundation in relation diagram*1) | $y_1$ | 3.216 | m |
| Unit weight of backfilling earth placed on back side of retaining wall | γ | 2.000 | $t/m^3$ |
| Unit weight of concrete reinforced with iron rod | Ws | 2.500 | $t/m^3$ |
| Action width of earth placed on rear side of retaining wall | bw | 0.620 | m |
| Weight of earth placed on heel plate of footing foundation*2) | We | 1.765 | t/m |
| Width of bottom plate of retaining wall block A'2 | Lw | 1.000 | m |
| Distance between ef on bottom plate of retaining wall block A'2 *3) | $y_2$ | 3.480 | m |
| Weight of earth placed on bottom plate *4) | Wo | 2.067 | t/m |
| Horizontal component force (approximate figure value of horizontal component of earth pressure) | $P_H$ | 6.500 | t/m |

TABLE 1-continued

| ITEMS | SYMBOL | VALUE | UNIT |
|---|---|---|---|
| Vertical component force (approximate figure value of vertical component of earth pressure) | $P_V$ | 2.000 | t/m |
| Friction coefficient between bottom surface of footing foundation and footing ground | $\mu$ | 0.600 | t/m |

Notes:
*1) Distance between ob' on heel plate of footing foundation, y1: $y_1 = (D_2 - t \times \sec\theta) \times \cot\theta + d_2) = (1.0 - 0.12 \times \sec 16.699°) \times \cot 16.699° + 0.3$
*2) Weight of earth placed on heel plate of footing foundation, We: $We = y_1(D_2 - t \times \cos\theta) \times \gamma/2 \times bw = 3.216 \times (1.0 - 0.12 \times \cos 16.699° \times 2.0/2 \times 0.62$
*3) Distance between ef on bottom plate of retaining wall block A'2, $y_2$: $y_2 = Lw \times \cos\theta \times \cot\theta + Lw \times \cos\theta \times \tan\theta = 1.0 \times \cos 16.699° \times \cot 16.699° + 1.0 \times \cos 16.699° \times \tan 16.699°$
*4) Weight of earth placed on bottom plate, Wo: $Wo = Lw \times \cos\theta \times y_2 \times \gamma/2 \times bw = 1.0 \times \cos 16.699° \times 3.48 \times 2.0/2 \times 0.62$

I. Retaining wall Y1 as Shown in FIG. 31

The computation is made using the computation conditions as shown in Table 2 below.

TABLE 2

| ITEM | SYMBOL | VALUE | UNIT |
|---|---|---|---|
| Width of toe portion of footing foundation | $D_1$ | 1.80 | m |
| Width of heel portion of footing foundation | $D_2$ | 1.00 | m |
| Total width of footing foundation | $D_3$ | 2.80 | m |
| Thickness of rear end portion of footing foundation | $d_1$ | 0.40 | m |
| Difference of thickness between tip portion and rear end portion of footing foundation | $d_2$ | 0.30 | m |
| Thickness of tip portion of footing foundation | $d_3$ | 0.70 | m |
| Sloping length of retaining wall of blocks A2 laid in four rows at angle θ | $S_{L1}$ | 4.00 | m |
| Sloping length of retaining wall of blocks A1 laid in three rows at angle θ | $S_{L2}$ | 3.00 | m |
| Vertical length of retaining wall of blocks A2 laid in four rows at angle θ | $h_1$ | 3.831 | m |
| Vertical length of retaining wall of blocks A1 laid in three rows at angle θ | $h_2$ | 2.873 | m |
| Total height of retaining wall from bottom surface of footing foundation to top of wall | H | 7.404 | m |

Using the above computation conditions, x is computed as follows:

$$x_1 = D_1 + (h_1 + h_2/2) \times \tan\theta + M_{GX}$$

$$= 1.8 + (3.831 + 2.873/2) \times \tan 16.699° + 0.2 = 3.580$$

$$x_2 = D_1 + h_1/2 \times \tan\theta + B_{GX} =$$

$$= 1.8 + 3.831/2 \times \tan 16.699° + 0.357 = 2.732$$

$$x_3 = D_3 - (D_2 - t \times \cos\theta)/3$$

$$= 2.8 - (1.0 - 0.12 \times \cos 16.699°)/3 = 2.505$$

$$x_4 = D_3/2 = 2.8/2 = 1.400$$

$$x_5 = D_1 - t \times \sec\theta + (H/3 - d_2) \times \tan\theta$$

$$= 1.8 + 0.12 \times \sec 16.699° + (7.404/3 - 0.7) \times \tan 16.699° = 2.456$$

$$x_6 = D_3 - D_2/3 = 2.8 - 1.0/3 = 2.467$$

II. Retaining Wall Y2 as Shown in FIG. 32

The computation is made using the computation conditions as shown in Table 3 below.

TABLE 3

| ITEM | SYMBOL | VALUE | UNIT |
|---|---|---|---|
| Width of toe portion of footing foundation | $D_1$ | 1.80 | m |
| Width of heel portion of footing foundation | $D_2$ | 1.00 | m |
| Total width of footing foundation | $D_3$ | 2.80 | m |
| Thickness of rear end portion of footing foundation | $d_1$ | 0.40 | m |
| Difference of thickness between tip portion and rear end portion of footing foundation | $d_2$ | 0.30 | m |
| Thickness of tip portion offooting foundation | $d_3$ | 0.70 | m |
| Sloping length of retaining wall of blocks A2 laid in three rows at angle θ | $S'_{L1}$ | 3.00 | m |
| Sloping length of retaining wall of blocks A'2 laid in one row at angle θ | $S'_{L2}$ | 1.00 | m |
| Sloping length of retaining wall of blocks A1 laid in three rows at angle θ | $S_{L3}$ | 3.00 | m |
| Vertical length of retaining wall of blocks A2 laid in three rows at angle θ | $h'_1$ | 2.873 | m |
| Vertical length of retaining wall of blocks A'2 laid in one rows at angle θ | $h'_2$ | 0.958 | |
| Vertical length of retaining wall of blocks A1 laid in three rows at angle θ | $h_3$ | 2.873 | m |
| Total height of retaining wall from bottom surface of footing foundation to top of wall | H | 7.404 | m |
| Angle of upper surface of bottom plate of block A'2 with respect to rear surface of retaining wall | α | 90 | ° |

Using the above computation conditions, x is computed as follows:

$$x_1 = D_1 + (h'_1 + h'_2 + h_3/2) \times \tan\theta + M_{GX}$$

$$= 1.8 + (2.873 + 0.958 + 2.873/2) \times \tan 16.699° + 0.2 = 3.580$$

$$x_2 = D_1 + h'_1 \times \tan\theta + B'_{GX} =$$

$$= 1.8 + 2.873/2 \times \tan 16.699° + 0.413 = 3.075$$

$$x_3 = D_1 + (h'_1 + t_0 \times \cos\theta - t \times \cos\theta \times \tan\theta) \times \tan\theta + t \times \sec\theta$$

$$+ Lw \times \cos\theta \times 2/3 = 1.8 + (2.873 + 0.12 \times \cos 16.699° -$$

$$0.12 \times \cos 16.699° \times \tan 16.699°) \times \tan 16.699° + 0.12 \times$$

$$\sec 16.699° + 1.0 \times \cos 16.699° \times 2/3 = 3.450$$

$$x_4 = D_1 + h_3 \times \tan\theta + B_{GX} = 1.8 + 2.873/2 \times \tan 16.699° +$$

$$0.357 = 2.588$$

$$x_5 = D_3 - (D_2 - t \times \cos\theta)/3 = 2.8 - (1.0 - 0.12 \times \cos 16.699°)/3 =$$

$$2.505$$

$$x_6 = D_3/2 = 2.8/2 = 1.400$$

$$x_7 = x_5 \text{ of Table 4} = 2.456$$

$$x_8 = D_3 - D_2/3 = 2.8 - 1.0/2 = 2.467$$

III. Comparison of the Axial Force N With Resistance Moment Mr for the Retaining Wall Y1

TABLE 4

| ITEM | EQUATION | N = w (t/m) | x (m) | Mr (t × m/m) |
|---|---|---|---|---|
| Retaining wall block A1 | $S_{L2} \times Mw = 3.0 \times 0.635$ | 1.905 | $x_1 = 3.580$ | 6.820 |
| Retaining wall block A2 | $S_{L1} \times Bw = 4.0 \times 0.991$ | 3.964 | $x_2 = 2.732$ | 10.830 |
| Earth on bottom plate: We | From Table 1 | 1.765 | $x_3 = 2.505$ | 4.421 |

TABLE 4-continued

| ITEM | EQUATION | N = w (t/m) | x (m) | Mr (t × m/m) |
|---|---|---|---|---|
| Footing foundation | $D_3 \times d_3 \times W_S$ = 2.8 × 0.7 × 2.5 | 4.900 | $x_4$= 1.400 | 6.860 |
| Vertical component force of earth pressure: PV | From Table 1 | 2.000 | $x_5$ = 2.456 | 4.912 |
| Σ1 | | 14.534 | | 33.843 |
| Deduction of footing foundation | $D_2 \times d_2 \times W_S/2$ = 1.0 × 0.3 × 2.5/2 | 0.375 | $x_6$ = 2.467 | 0.925 |
| Σ2 | | 14.159 | | 32.918 |

IV. Comparison of the Axial Force N With Resistance Moment Mr for the Retaining Wall Y2

TABLE 5

| ITEM | EQUATION | N = w (t/m) | x (m) | Mr (t × m/m) |
|---|---|---|---|---|
| Retaining wall block A1 | $S_{L3} \times Mw$ = 3.0 × 0.635 | 1.905 | $x_1$ = 3.580 | 6.820 |
| Retaining wall block A'2 | $S_{L2} \times B'w$ = 1.0 × 1.203 | 1.203 | $x_2$ = 3.075 | 3.699 |
| Earth on bottom plate of block A'2 | From Table 1 | 2.067 | $x_3$ = 3.450 | 7.131 |
| Retaining wall block A2 | $S'_{L1} \times Bw$ = 3.0 × 0.991 | 2.973 | $x_4$ = 2.588 | 7.694 |
| Earth on bottom plate: We | From Table 1 | ≐ 1.765 | $x_5$ = 2.505 | 4.421 |
| Footing foundation | $D_3 \times d_3 \times W_S$ = 2.8 × 0.7 × 2.5 | 4.900 | $X_6$ = 1.400 | 6.860 |
| Vertical component force of earth pressure: PV | From Table 1 | 2.000 | $X_7$ = 2.456 | 4.912 |
| Σ1 | | 16.813 | | 41.537 |
| Deduction of footing foundation | $D_2 \times d_2 \times W_S/2$ = 1.0 × 0.3 × 2.5/2 | 0.375 | $X_8$ = 2.467 | 0.925 |
| Σ2 | | 16.438 | | 40.612 |

V. Comparison of the Axial Force N With Resistance Moment Mr

TABLE 6

| ITEMS | TABLE 4 (A) | TABLE 5 (B) | (B)/(A) |
|---|---|---|---|
| N | 14.159 t/m | 16.438 t/m | 1.16 |
| Mr | 32.918 t × t/m | 40.612 t × m/m | 1.23 |

VI. Stationary Allowable Safety Factor

TABLE 7

| SLIDING SAFETY FACTOR: FS1 | e | Remarks |
|---|---|---|
| FS1 ≧ 1.5 | $e \leqq D_2/6$ | Eccentric distance from center of footing foundation to point of application of resultant force |

VII. Comparison of Sliding Safety Factors

TABLE 8

| | | |
|---|---|---|
| TABLE 6 (A) | FS1 = N $\mu$/PH = 14.159 × 0.6/6.5 = 1.31 < 1.50 | (NOT GOOD) |
| TABLE 6 (B) | FS1 = N $\mu$/PH = 16.438 × 0.6/6.5 = 1.52 > 1.50 | (GOOD) |

VIII. Comparison of values e Relating to Falling Down:

TABLE 9

| | | |
|---|---|---|
| TABLE 6 (A) | $e = D_3/2 - (Mr-M)/N$ = 2.8/2 − (32.918 − 16.042)/14.159 = 0.208 m < $D_3/6$ = 0.467 | (GOOD) |
| TABLE 6 (B) | $e = D_3/2 - (Mr-M)/N$ = 2.8/2 − (40.612 − 16.042)/16.438 = −0.095 m < $D_3/6$ = 0.467 | (GOOD) |
| REMARKS | M = PH × H/3 = 6.5 × 7.404/3 = 16.042 t × m/m | |

From the results of comparison as described above, it can be found that the retaining wall block A'2 according to the tenth embodiment of the present invention can particularly achieve favorable effects of the resistance against the external forces acting upon the side of the retaining wall because it can have an extremely good sliding safety factor and high eccentric distance e relating to falling down or overturning. It is also found that the effects can further be improved by enlarging the lengthwise width Lw of the bottom plate 17.

Moreover, it is to be understood that the above-mentioned configurations of the medium-sized retaining wall blocks A2 can be applied to the large-sized retaining wall blocks A3 as indicated in accordance with the second through tenth embodiments or other blocks and likewise that the above-mentioned configurations of the large-sized retaining wall blocks A3 can be applied to the medium-sized retaining wall blocks A2 as indicated in accordance with the second through tenth embodiments or other blocks.

EFFECTS OF THE INVENTION

As described above, the present invention provides a retaining wall block comprised of a front wall and a partition wall with a communicating hole extending vertically over the entire length thereof which a reinforcing iron rod is inserted and disposed, wherein the partition wall is provided on a top surface thereof with an upper depression and on a bottom surface thereof with a lower depression so as to allow the upper and lower depressions to communicate with each other through the communicating hole and each of the upper depression and the lower depression is set to be longer in lengthwise diameter, i.e., the diameter extending from the front side to the rear side, than the communicating hole, the upper depression forming a depression portion in a concave form extending from a rear side wall end of the front wall to a rear end of the partition wall and enclosed at its edges with a downwardly extending edge portion having a flat top surface, the upper depression and the lower depression are configured such that, when the retaining wall blocks are laid in plural rows, the upper depression of the retaining wall block disposed in a row forms a node-shaped cavity in association with the lower depression of the retaining wall block laid upwardly in an upper row; the lower depression of the retaining wall block disposed in the row form a node-shaped cavity in association with the upper depression of the retaining wall block disposed in a lower row; each of the node-shaped cavities is less in lengthwise diameter, i.e. the diameter extending from the front side to the rear side, than the lengthwise diameter of the top or bottom openings, respectively; and the communicating hole is configured such that the communicating hole forms a column-shaped body of a filling and setting material such as, e.g. concrete, mortar, etc. when it is filled therethrough and set therein and such that each of the node-shaped cavities forms a node-shaped body of the filling and setting material filled and set therein connected integrally to the column-shaped body and projecting transversely from the peripheral side portion of the column-shaped body. The configuration of the node-shaped projection in association with the column-shaped body can provide a retaining wall with strong resistance against external forces such as, e.g. lateral shear forces, etc. acting particularly upon the contact surface at which the retaining wall block in the upper row is laid upwardly on the retaining wall block in the lower row The retaining wall constructed by the retaining wall blocks according to the present invention has a physical strength comparable to with cast-in-place retaining walls.

In another mode, the present invention provides a retaining wall block comprised of a front wall and a partition wall with a plurality of communicating holes each extending vertically over the entire length thereof through which a reinforcing iron or rods is or are inserted and disposed, wherein the plurality of the communicating holes are disposed such that the adjacent communicating holes communicate with each other via a communicating opening; the plurality of the communicating holes form column-shaped bodies of a filling and setting material filled therethrough and cured therein; and the communicating opening forms a connecting body or bodies of the cured filling and setting material connecting the adjacent column-shaped bodies thereof to each other. The interconnection of the column-shaped bodies with the connecting body or bodies in the retaining wall blocks can provide a retaining wall having strong resistance particularly against external forces that cause the column-shaped body or bodies, i.e. the retaining wall blocks constituting the retaining wall, to slide upwardly or downwardly. More specifically, when a retaining wall is constructed with the retaining wall blocks having the configuration as described above as a rigid structure, in usual cases, the filling and setting material filled and cured in the communicating hole or holes of the retaining wall blocks structuring the retaining wall can demonstrate the resistance to a positive bending moment caused by external forces such as earth pressure, etc., acting upon the rear wall side of the retaining wall toward the front wall side thereof Moreover, even at the time of earthquake, etc., the retaining wall can withstand a negative bending moment caused by such earthquake, which acts upon the retaining wall in an opposite way, i.e., from the front side wall toward the rear side wall, because the filling and setting material filled and cured therein can work as a rigid structure in substantially the same manner as in usual cases. Furthermore, the retaining wall according to the present invention can save the amount of interconnecting iron rods to be disposed in the footing foundation, thereby reducing the costs of construction.

In a preferred mode, the communicating hole is configured in such a fashion that it is gradually tapered downwardly from the top opening portion thereof toward the middle portion thereof such that the lengthwise diameter of the communicating hole at the top opening portion is larger than the lengthwise diameter thereof at the middle opening portion and downwardly from the middle opening portion toward the bottom opening portion such that the lengthwise diameter thereof at the middle opening portion is less than that at the bottom opening portion. This configuration of the communicating hole or holes can particularly assist in preventing the column-shaped body or bodies of the filling and setting material cured therein from sliding upwardly or downwardly when the external forces act upon the retaining wall to cause it to slide upwards or downwards.

In a preferred mode, the present invention provides the retaining wall block having the front wall and the partition wall with a plurality of communicating holes each extending vertically over the entire length thereof, wherein a sub-partition wall is provided between the adjacent communicating holes such that the top and bottom surfaces of the sub-partition wall is located in the position lower than the top surface of the partition wall or above the bottom surface thereof to provide an upper opening space or a lower opening space so as to allow the upper and lower portions of the adjacent communicating holes to communicate with each other; or such that the sub-partition wall is provided with a communicating opening space or spaces through and in the sub-partition wall so as to allow the adjacent communicating holes to communicate with each other; and the communicating opening space or spaces forms or form the connecting body or bodies of the filling and setting material filled and set therein so as to connect the column-shaped bodies of the filling and setting material to each other.

In the configuration of the retaining wall block as described above, the upper opening space of the retaining wall block disposed in a lower row can form a connecting cavity in association with the lower opening space of the retaining wall block laid in an adjacent upper row and likewise the lower opening space of the retaining wall block disposed in the lower row can form a connecting cavity in association with the upper opening space of the retaining wall block laid in an adjacent lower row. Each of the connecting cavities can form a connecting body of the filling and setting material integrally connecting the adjacent column-shaped bodies of the filling and setting material to each other, when the filling and setting material is filled in the plurality of the communicating holes and allowed to set and cure therein. The interconnecting configuration of the connecting body or bodies with the column-shaped bodies can provide a retaining wall having strong resistance particularly against external forces that cause the column-shaped bodies, i.e. the retaining wall blocks constituting the retaining wall, to slide upwardly or downwardly.

In another preferred mode, the communicating hole is configured in such a manner that it is gradually tapered downwardly from the top opening portion toward the middle portion in association with the surface of the sub-partition wall facing the opposed surface such that the lengthwise diameter of the communicating hole at the top opening portion is larger than the lengthwise diameter thereof at the middle opening portion and downwardly from the middle opening portion toward the bottom opening portion such that the lengthwise diameter thereof at the middle opening portion is less than that at the bottom opening portion. This configuration of the communicating hole or holes can particularly assist in preventing the column-shaped body or bodies of the filling and setting material cured therein from sliding vertically, i.e., upwardly or downwardly, when the external forces acts upon the retaining wall upwards or downwards.

In a further preferred mode, the present invention provides the retaining wall block having the partition wall with a plurality of communicating holes extending vertically over the entire length thereof such that a pair of upper and lower beams are interposed between adjacent communicating holes so as to form a communicating opening space therebetween; and the filling and setting material filled through and in the communicating opening space is set and cured to form a connecting body connecting integrally to the column-shaped bodies of the filling and setting material set and cured in the communicating holes. This configuration of the communicating holes in association with the communicating opening space can likewise withstand the external forces against the retaining wall so as to slide the column-shaped body or bodies of the filling and setting material cured therein upwardly or downwardly.

In a still further mode, the pair of the upper and lower beams are configured in such a fashion that the upper beam is disposed so as for the top surface thereof to be located below the top opening portion of the communicating hole to provide the communicating opening space and the lower beam is disposed so as for the bottom surface thereof to be located above the bottom opening portion thereof to provide the communicating space, thereby communicating the adjacent communicating holes at their respective top and bottom portions with each other. The upper and lower communicating opening spaces can likewise provide the connecting bodies of the filling and setting material cured therein, thereby preventing the column-shaped bodies of the filling and setting material from sliding upwardly on downwardly due to the external forces.

In a still further mode, the pair of the upper and lower beams are configured in such a fashion that the upper beam is gradually tapered downwardly from its top portion toward the bottom portion such that the lengthwise width extending from the front side to the back side of the upper beam is narrower than the lengthwise diameter thereof at the bottom portion and the lower beam is gradually tapered downwardly from its top portion toward the bottom portion such that the lengthwise width extending from the front side to the back side of the lower beam is wider than the lengthwise diameter thereof at the bottom portion. This configuration of the upper and lower beams in association with the communicating hole or holes can provide a column-shaped body or bodies of the filling and setting material cured in the communicating hole or holes in the form in which the front and back side surfaces of the column-shaped body or bodies are corrugated so as to prevent the column-shaped body or bodies from sliding upwardly or downwardly due to external forces.

In a still further aspect, the retaining wall block is provided with a bottom plate integrally formed with the bottom end portions of the front wall and the partition wall extending backwards from the bottom end portion of the front wall parallel to the partition wall up to the position generally equal to or behind the back side end of the partition wall. When the retaining wall is constructed with the retaining wall blocks of the other types in combination with the retaining wall block with the bottom plate and the back side of the retaining wall is filled with a backfill material, the backfill material placed on the bottom plate imposes weight on the retaining wall block with the bottom plate backwards and downwards and eventually on the retaining wall blocks laid in lower rows and increases friction forces at each of the adjacent retaining wall blocks laid upwardly in adjacent rows, thereby preventing a sliding movement of the retaining wall and increasing stability of the retaining wall. This configuration can also assist in reducing the area of the footing foundation so that the ground area for the footing foundation can be reduced, thereby shortening the period of construction and reducing costs of construction. Moreover, the provision of the retaining wall block with the bottom plate can ensure a high strength for the retaining wall as a three-side fix type structure in which the retaining wall block is secured through its three sides.

In another aspect of the present invention, the method for constructing a retaining wall or a like construction with the retaining wall blocks as described above, which comprises laying the retaining wall blocks in a row upwardly on the footing foundation with anchoring iron rods disposed thereon so as to allow the communicating hole or holes to align with the anchoring iron rods of the footing foundation, filling the communicating hole or holes with the filling and setting material, laying the retaining wall blocks in an upper row upwardly on the retaining wall blocks disposed in the lower row so as to allow the communicating hole or holes to align with the communicating hole or holes of the retaining wall blocks disposed in the lower row, filling the communicating hole or holes of the retaining wall blocks in the upper row with the filling and setting material, and repeating this series of steps comprising laying, filling and laying until the retaining wall reaches its predetermined height. When the filling and setting material filled in the communicating hole or holes as well as the communicating opening or openings formed bridging the adjacent communicating holes, the communicating hole or holes as well as the communicating opening or openings is or are filled with the filling and setting material and form or forms the connecting body or bodies of the filling and setting material when the filling and setting material is allowed to set and cure. The resulting retaining wall can offer the features and advantages that can be achieved by the retaining wall blocks themselves when constructed into a retaining wall or like constructions and by the interconnection of the connecting body or bodies of the filling and setting material with the column-shaped body or bodies thereof.

In a preferred mode, the column-shaped body or bodies of the filling and setting material formed by filling the filling and setting material in the communicating hole or holes and allowing it to set and cure therein may be provided with a node-shaped projection or projections formed by filling the filling and setting material in the node-shaped cavity or cavities interposed between the retaining wall blocks laid in adjacent upper and lower rows and the node-shaped projection or projections can serve as preventing the column-shaped body or bodies thereof from sliding upwardly or downwardly due to external forces as well as withstand the positive and negative bending moment caused by the external forces such as, e.g. lateral shear forces, etc., acting upon the retaining wall from the sides. Using the retaining wall blocks according to the present invention, it is possible to construct a retaining wall having physical strength comparable to cast-in-place constructions.

Further, in a preferred mode, the retaining wall block may be configured such that the upper depression thereof is provided with the additional reinforcing iron rods in a network or lattice configuration. The disposition of the additional iron rods in such a network or lattice configuration can further improve the resistance of the retaining wall against the external forces, such as lateral shear forces, etc. Further, the additional iron rods can also function the positioning of the interconnecting reinforcing iron rods, thereby ensuring the reinforcement of the interconnecting iron rods disposed in the communicating hole or holes.

What is claimed is:

1. A retaining wall block comprising a front wall and a partition wall with a communicating hole extending vertically over the entire length thereof, through which a reinforcing iron rod is inserted and disposed, wherein:

said partition wall is provided with an upper depression on a top surface thereof so as to be depressed downwardly and with a lower depression on a bottom surface thereof so as to be depressed upwardly such that the upper depression communicates with the lower depression through the communicating hole;

each of said upper depression and lower depression is formed such that a lengthwise diameter of each of said upper depression and lower depression is wider than a lengthwise diameter of each of a top opening portion and a bottom opening portion of the communicating hole, respectively;

said upper depression of the retaining wall block in the lower row forms a node-shaped cavity in association with the lower depression in the upper row; the node-shaped cavity communicates with the communicating hole, when the retaining wall block in an upper row is laid upwardly on top of the retaining wall block in a lower row;

said node-shaped cavity is configured such that a lengthwise diameter of the node-shaped cavity is larger than a lengthwise diameter of the communicating hole;

said communicating hole forms a column-shaped body of a filling and setting material filled therethrough and cured therein, said communicating hole being gradually tapered inwardly from a top opening portion toward a middle opening portion such that a lengthwise diameter of said communicating hole at the top opening portion thereof is larger than a lengthwise diameter of said communicating hole at the middle opening portion thereof and then downwardly from the middle opening portion thereof toward a bottom opening portion thereof such that the lengthwise diameter of said communicating hole at the middle opening portion is less than a lengthwise diameter of said communicating hole at the bottom opening portion; and said node-shaped cavity forms a node-shaped body of the filling and setting material filled therethrough and cured therein, which is integrally connected to said column-shaped body thereof.

2. A retaining wall block comprising a front wall and a partition wall with a plurality of communicating holes, each extending vertically over an entire length thereof, through which a reinforcing iron rod is inserted and disposed, wherein:

said plurality of communicating holes are disposed such that adjacent communicating holes communicate with each other via a communicating opening;

each of said plurality of communicating holes forms a column-shaped body of a filling and setting material when a filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein; and each of said plurality of communicating holes is gradually tapered inwardly from a top opening portion toward a middle opening portion such that a lengthwise diameter of a communicating hole at the top opening portion thereof is larger than a lengthwise diameter of said communicating hole at the middle opening portion thereof and downwardly from the middle opening portion thereof toward a bottom opening portion thereof such that the lengthwise diameter of said communicating hole at the middle opening portion is less than a lengthwise diameter of said communicating hole at the bottom opening portion.

3. A retaining wall block comprising a front wall and a partition wall with a plurality of communicating holes, each extending vertically over an entire length thereof, through which a reinforcing iron rod is inserted and disposed, wherein:

said plurality of communicating holes are disposed such that adjacent communicating holes communicate with each other via a communicating opening;

each of said plurality of communicating holes forms a column-shaped body of a filling and setting material when the filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein;

said partition wall is provided with an upper depression on a top surface thereof so as to be depressed downwardly and with a lower depression on a bottom surface thereof so as to be depressed upwardly such that the upper depression communicates with the lower depression through a communicating hole;

each of said upper depression and lower depression is formed such that a lengthwise diameter of each of said upper depression and said lower depression is wider than a lengthwise diameter of each of a top opening portion and a bottom opening portion of the communicating hole, respectively;

said upper depression of the retaining wall block in a lower row forms a node-shaped cavity in association with the lower depression in an upper row; the node-shaped cavity communicates with the communicating hole, when the retaining wall block in an upper row is laid upwardly on top of the retaining wall block in a lower row;

said node-shaped cavity is configured such that a lengthwise diameter of the node-shaped cavity is larger than a lengthwise diameter of the communicating hole; said communicating hole forms a column-shaped body of a filling and setting material filled therethrough and cured therein, said communicating hole is gradually tapered inwardly from a top opening portion toward a middle opening portion such that a lengthwise diameter of said communicating hole at the top opening portion thereof is larger than a lengthwise diameter of said communicating hole at the middle opening portion thereof and downwardly from the middle opening portion thereof toward a bottom opening portion thereof such that the lengthwise diameter of said communicating hole at the middle opening portion is less than a lengthwise diameter of said communicating hole at the bottom opening portion; and said node-shaped cavity forms a node-shaped body of the filling and setting material filled therethrough and cured therein, which is integrally connected to said column shaped body thereof.

4. A retaining wall block comprising a front wall and a partition wall with a plurality of communicating holes, each extending vertically over an entire length thereof, through which a reinforcing iron rod is inserted and disposed, wherein:

said plurality of communicating holes are disposed such that adjacent communicating holes communicate with each other via a communicating opening;

each of said plurality of communicating holes forms a column shaped body of a filling and setting material when the filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein;

a sub-partition wall is provided between the adjacent communicating holes such that a top surface of the sub-partition wall is located in the position lower than a top surface of the partition wall to provide an upper opening space so as to allow upper portions of the adjacent communicating holes to communicate with each other; and a bottom surface of the sub-partition wall is located in a position above a bottom surface of the partition wall so as to allow lower portions of the adjacent communicating holes to communicate with each other;

said upper opening space of the retaining wall block forms an upper connecting cavity in association with said lower opening space of the retaining wall block laid in an adjacent upper row;

said lower opening space of the retaining wall block forms a lower connecting cavity in association with the upper opening space of the retaining wall block laid in an adjacent lower row; and each of said upper and lower connecting cavities forms a connecting body of the filling and setting material filled therethrough and cured therein, which integrally connects the adjacent column-shaped bodies of the filling and setting material when the filling and setting material is filled and set in the plurality of the communicating holes.

5. The retaining wall block as claimed in claim 4, wherein: each of said communicating holes is gradually tapered inwardly from a top opening portion toward a middle opening portion such that a lengthwise diameter of said communicating hole is larger than a lengthwise diameter thereof at the middle opening portion and downwardly from the middle opening portion toward a bottom opening portion thereof such that the lengthwise diameter of said communicating hole at the middle opening portion is less than a lengthwise diameter thereof at the bottom opening portion.

6. A retaining wall block comprising a front wall and a partition wall with a plurality of communicating holes, each extending vertically over an entire length thereof, through which a reinforcing iron rod is inserted and disposed, wherein:

said plurality of communicating holes are disposed such that adjacent communicating holes communicate with each other via a communicating opening;

each of said plurality of communicating holes forms a column-shaped body of a filling and setting material when the filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein;

said partition wall is provided with an upper depression on a top surface thereof so as to be depressed downwardly and with a lower depression on a bottom surface thereof so as to be depressed upwardly such that the upper depression communicates with the lower depression through a communicating hole;

each of said upper depression and lower depression is formed such that a lengthwise diameter of each of said upper depression and lower depression is wider than a lengthwise diameter of each of a top opening portion and a bottom opening portion of the communicating hole, respectively;

said upper depression of the retaining wall block in a lower row forms a node-shaped cavity in association with the lower depression in an upper row; the node-shaped cavity communicates with the communicating hole, when the retaining wall block in an upper row is laid upwardly on top of the retaining wall block in a lower row;

said node-shaped cavity is configured such that a lengthwise diameter of the node-shaped cavity is larger than a lengthwise diameter of the communicating hole;

said communicating hole forms a column-shaped body of a filling and setting material filled therethrough and cured therein;

said node-shaped cavity forms a node-shaped body of the filling and setting material filled therethrough and cured therein, which is integrally connected to said column-shaped body thereof;

a sub-partition wall is provided between the adjacent communicating holes such that a top surface of the sub-partition wall is located in the position lower than a top surface of the partition wall to provide an upper opening space so as to allow upper portions of the adjacent communicating holes to communicate with each other; and a bottom surface of the partition wall is located in the position above a bottom surface of the partition wall so as to allow lower portions of the adjacent communicating holes to communicate with each other;

said upper opening space of the retaining wall block forms an upper connecting cavity in association with a lower opening space of the retaining wall block laid in an adjacent upper row;

said upper opening space of the retaining wall block forms a lower connecting cavity in association with the upper opening space of the retaining wall block laid in an adjacent lower row; and each of said upper and lower connecting cavities forms a connecting body of the filling and setting material filled therethrough and cured therein, which integrally connects the adjacent lower row; and each of said upper and lower connecting cavities forms a connecting body of the filling and setting material filled therethrough and cured therein, which integrally connects the adjacent column-shaped bodies of the filling and setting material when the filling and setting material is filled and set in the plurality of the communicating holes.

7. The retaining wall block as claimed in claim 6, wherein: each of said communicating holes is gradually tapered inwardly from a top opening portion toward a middle opening portion such that a lengthwise diameter of said communicating hole is larger than a lengthwise diameter thereof at the middle opening portion and downwardly from the middle opening portion toward a bottom opening portion thereof such that the lengthwise diameter of said communicating hole at the middle opening portion is less than lengthwise diameter thereof at the bottom opening portion.

8. A retaining wall block comprising a front wall and a partition wall with a plurality of communicating holes, each extending vertically over an entire length thereof, through which a reinforcing iron rod is inserted and disposed, wherein:

said plurality of the communicating holes are disposed such that adjacent communicating holes communicate with each other via a communicating opening;

each of said plurality of the communicating holes forms a column-shaped body of a filling and setting material when the filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein;

a sub-partition wall is provided between the adjacent communicating holes;

said sub-partition wall is provided at an intermediate portion thereof with a communicating opening to allow the adjacent communicating holes to communicate with each other; and the communicating opening forms a connecting body of the filling and setting material filled therethrough and cured therein, which integrally connects the adjacent column-shaped bodies of the filling and setting material when the filling and setting material is filled in the plurality of the communicating holes and allowed to set and cure.

9. The retaining wall block as claimed in claim 8, wherein:

said sub-partition wall is configured such that a top surface thereof is located in a position below a top surface of the communicating opening to form a first communicating opening portion so as to allow upper portions of adjacent communicating holes to communicate with each other and a bottom surface thereof is located in a position above a bottom surface of the communicating opening to form a second communicating opening portion so as to allow lower portions of the adjacent communicating holes to communicate with each other;

said first and second communicating opening portions form first and second connecting bodies of the filling and setting material filled therethrough and cured therein, respectively, which are integrally formed so as to connect the adjacent column-shaped bodies of the filling and setting material formed in the adjacent communicating holes, when the filling and setting material is filled through the communicating holes and cured therein.

10. A retaining wall block comprising a front wall and a partition wall with a plurality of communicating holes, each extending vertically over an entire length thereof, through which a reinforcing iron rod is inserted and disposed, wherein:

said plurality of communicating holes are disposed such that adjacent communicating holes communicate with each other via a communicating opening;

each of said plurality of communicating holes forms a column-shaped body of a filling and setting material when the filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein;

said partition wall is provided with an upper depression on a top surface thereof so as to be depressed downwardly and with a lower depression on a bottom surface thereof so as to be depressed upwardly such that the upper depression communicates with the lower depression through a communicating hole;

each of said upper depression and said lower depression is formed such that a lengthwise diameter of each of said upper depression and said lower depression is wider than a lengthwise diameter of each of a top opening portion and a bottom opening portion of the communicating hole, respectively;

said upper depression of the retaining wall block in a lower row forms a node-shaped cavity in association with the lower depression in an upper row; the node-shaped cavity communicates with the communicating hole, when the retaining wall block in an upper row is laid upwardly on top of the retaining wall block in a lower row;

said node-shaped cavity is configured such that a lengthwise diameter of the node-shaped cavity is larger than a lengthwise diameter of the communicating hole;

said communicating hole forms a column-shaped body of the filling and setting material filled therethrough and cured therein, which is integrally connected to said column-shaped body thereof;

a sub-partition wall is provided between the adjacent communicating holes;

said sub-partition wall is provided at an intermediate portion thereof with a communicating opening to allow the adjacent communicating holes to communicate with each other; and the communicating opening forms a connecting body of the filling and setting material filled therethrough and cured therein, which integrally connects the adjacent column-shaped bodies of the filling and setting material when the filling and setting material is filled in the plurality of communicating holes and allowed to set and cure.

11. The retaining wall block as claimed in claim 10, wherein:

said sub-partition wall is configured such that a top surface thereof is located in a position below a top surface of the communicating opening to form a first communicating opening portion so as to allow upper portions of the adjacent communicating holes to communicate with each other and a bottom surface thereof is located in a position above a bottom surface of the communicating opening to form a second communicating opening portion so as to allow lower portions of the adjacent communicating holes to communicate with each other;

said first and second communicating opening portions form first and second connecting bodies of the filling and setting material filled therethrough and cured therein, respectively, which are integrally formed so as to connect the adjacent column-shaped bodies of the filling and setting material formed in the adjacent communicating holes, when the filling and setting material is filled through the communicating holes and cured therein.

12. A retaining wall block comprising a front wall and a partition wall with a plurality of communicating holes, each extending vertically over an entire length thereof, through which a reinforcing iron rod is inserted and disposed, wherein:

said plurality of the communicating holes are disposed such that adjacent communicating holes communicate with each other via a communicating opening;

each of said plurality of communicating holes forms a column-shaped body of a filling and setting material when a filling and setting material is filled therethrough and set therein;

said communicating opening forms a connecting body of the filling and setting material filled therethrough and set therein, which integrally connects adjacent column-shaped bodies thereof to each other when the filling and setting material is filled therethrough and set therein;

said partition wall is provided with a plurality of communicating holes disposed in a lengthwise arrangement, each extending vertically over an entire length thereof;

a pair of upper and lower beams are interposed between adjacent communicating holes;

said pair of upper and lower beams are disposed at upper and lower portions in a vertically spaced relationship between the adjacent communicating holes, respectively, to form a communicating opening interposed therebetween;

said adjacent communicating opening forms a connecting body of the filling and setting material filled therethrough and cured therein, which integrally connects the adjacent column-shaped bodies of the filling and setting material thereto, when the filling and setting material filled through the plurality of the communicating holes is cured therein.

13. The retaining wall block as claimed in claim 12, wherein:

said upper beam is configured such that a top surface of said upper beam is located in the position lower than a top surface of said partition wall to provide a first opening space so as to allow upper portions of the adjacent communicating holes to communicate with each other and a bottom surface thereof is located in the position above a bottom surface of said partition wall to provide a second opening space so as to allow lower portions of the adjacent communicating holes to communicate with each other;

said first opening space of the retaining wall block forms a first connecting cavity in association with said second opening space of the retaining wall block laid in an adjacent upper row;

said second opening space of the retaining wall block form a second connecting cavity in association with the first opening space of the retaining wall block laid in an adjacent lower row;

said first and second connecting cavities form each a connecting body of the filling and setting material filled therethrough and cured therein, which integrally connects the adjacent column-shaped bodies of the filling and setting material to each other, when the filling and setting material is filled in the plurality of the communicating holes and allowed to set therein.

14. The retaining wall block as claimed in claim 12, wherein:

said partition wall is provided with an upper depression on a top surface thereof so as to be depressed downwardly and with a lower depression on a bottom surface thereof so as to be depressed upwardly such that the upper depression communicates with the lower depression through the communicating hole;

each of said upper depression and lower depression is formed such that a lengthwise diameter of each of said upper depression and lower depression is wider than a lengthwise diameter of each of a top opening portion and a bottom opening portion of the communicating hole, respectively;

said upper depression of the retaining wall block disposed is a lower row forms a node-shaped cavity in association with the lower depression of the retaining wall block laid in an upper row such that the node-shaped cavity communicates with the communicating hole, when the retaining wall block in an upper row is laid upwardly on the retaining wall block disposed in a lower row;

said communicating hole forms a column-shaped body of a filling and setting material when the filling and setting material is filled through the communicating hole and cured therein; and said node-shaped cavity forms a node-shaped body of the filling and setting material filled therethrough and cured therein, which integrally connects the adjacent column-shaped bodies thereof thereto, when the filling and setting material is filled through the node-shaped cavity through the communicating hole and cured therein.

15. The retaining wall block as claimed in claim 14, wherein:

said upper beam is configured such that top surface of said upper beam is located in a position lower than a top surface of said partition wall to provide a first opening space so as to allow upper portions of the adjacent communicating holes to communicated with each other and a bottom surface thereof is located in a position above a bottom surface of said partition wall to provide a second opening space so as to allow lower portions of the adjacent communicating holes to communicate with each other;

said first opening space of the retaining wall block forms a first connecting cavity in association with said second opening space of the retaining wall block laid in an adjacent upper row;

said second opening space of the retaining wall block form a second connecting cavity in association with the first opening space of the retaining wall block laid in an adjacent lower row;

said first and second connecting cavities form each a connecting body of the filling and setting material filled therethrough and cured therein, which integrally connects the adjacent column-shaped bodies of the filling and setting material to each other, when the filling and setting material is filled in the plurality of the communicating holes and allowed to set therein.

16. The retaining wall block as claimed in claim 14, wherein:

said upper beam in gradually tapered inwardly from a top portion toward a bottom portion such that a lengthwise diameter of the upper beam at the top portion is less than a lengthwise diameter thereof at the bottom portion;

said lower beam is gradually tapered downwardly from a top portion toward a bottom portion such that a lengthwise diameter of the lower beam at the top portion is larger than a lengthwise diameter thereof at the bottom opening portion;

said upper and lower beams are configured such that the communicating hole is gradually tapered inwardly from a top opening portion toward a middle opening portion such that a lengthwise diameter of the communicating hole at the top opening portion is larger than a lengthwise diameter thereof at the bottom opening portion and downwardly from the middle opening portion toward a bottom opening portion thereof such that a lengthwise diameter of the communicating hole at the middle opening portion is less than a lengthwise diameter thereof at the bottom opening portion.

17. A method for constructing a retaining wall with retaining wall blocks laid upwardly in plural rows by a series of steps comprising:

laying the retaining wall block or blocks upwardly in an upper row on the retaining wall block or blocks disposed in a lower row so as to upwardly align a communicating hole or holes of the retaining wall block or blocks laid in the upper row with a communicating hole or holes of the retaining wall block or blocks disposed in the lower row; said communicating hole or each of the communicating holes being gradually tapered inwardly from a top opening portion or portions toward a middle portion or portions such that a lengthwise diameter of the communicating hole at the top opening portion thereof is larger than a lengthwise diameter of the communicating hole at the middle opening portion and downwardly from the middle opening portion toward a bottom opening portion thereof such that the lengthwise diameter of the communicating hole at the middle opening portion is less than a lengthwise diameter thereof at the bottom opening portion;

filling the communicating hole or holes with a filling and setting material and allowing the filling and setting material filled therein to set and cure therein;

laying the retaining wall block or blocks in another row on top of the retaining wall block or blocks disposed in the upper layer so as to upwardly align a communicating hole or holes of the retaining wall block or blocks in the another row with the communicating hole or holes of the retaining wall block or blocks disposed in the upper row, filling the communicating hole or holes with a filling and setting material and allowing the filling and setting material filled therein to set and cure, and repeating a series of steps comprised of laying, filling and curing at predetermined times until the retaining wall reaches a predetermined height; wherein:

filling the filling and setting material through and in the communicating hole or holes of the retaining wall block or blocks in the lower row up to a top opening portion or portions of the retaining wall block or blocks and allowing it to cure to form a column-shaped body or bodies of the filling and setting material;

laying the retaining wall block or blocks each having upper and lower depressions in the upper row upwardly on the corresponding retaining wall block or blocks each having upper and lower depressions disposed in the lower row, on the one hand, so as to upwardly align the communicating hole or holes of the retaining wall block or blocks in the upper row with the communicating hole or holes of the retaining wall block or blocks in the lower row so as to align a lower depression or depressions of the retaining wall block or blocks in the upper row with a lower depression or depressions of the retaining wall block or blocks in the another row to form an upper cavity or cavities;

filling the filling and setting material through and in the communicating hole or holes to form a column-shaped body of the filling and setting material when set and cured therein; and filling the filling and setting material in the upper and lower cavities through the communicating hole or holes to form upper and lower node-shaped bodies of the filling and setting material so as far their respective peripheral portion or portions projects or project from a peripheral portion of the column-shaped body or bodies of the filling and setting material cured therein.

18. A method for constructing a retaining wall with retaining wall blocks laid upwardly in plural rows by a series of steps comprising:

laying the retaining wall block or blocks upwardly in an upper row on the retaining wall block or blocks disposed in a lower row so as to upwardly align a communicating hole or holes of the retaining wall block or blocks laid in the upper row with a communicating hole or holes of the retaining wall block or blocks laid in the lower row, the communicating hole or each of the communicating holes being gradually tapered inwardly from a top opening portion or portions toward a middle portion or portions such that lengthwise diameter of the communicating hole at the top opening portion thereof is larger than a lengthwise diameter of the communicating hole at a middle opening portion and downwardly from the middle opening portion toward a bottom opening portion thereof such that the lengthwise diameter of the communicating hole at the middle opening portion is less than a lengthwise diameter thereof at the bottom opening portion;

filling the communicating hole or holes with a filling and setting material and allowing the filling and setting material filled therein to set and cure;

laying the retaining wall block or blocks in another row on the retaining wall block or blocks disposed in an upper layer so as to upwardly align a communicating hole or holes of the retaining wall block or blocks in another row with the communicating hole or holes of the retaining wall block or blocks disposed in the upper row;

filling the communicating hole or holes with a filling and setting material and allowing the filling and setting material filled therein to set and cure;

repeating a series of steps comprised of laying, filling and curing at predetermined times until the retaining wall reaches a predetermined height;

filling the filling and setting material through and in the communicating holes and allowing it to cure to form a column-shaped body or bodies of the filling and setting material; and filling the filling and setting material through the communicating holes in the communicating opening or openings communicating the communicating holes with each other and allowing it to cure to form a connecting body or bodies of the filling and setting material integrally connecting the column-shaped bodies.

* * * * *